US010161209B1

(12) United States Patent
Hutchinson

(10) Patent No.: US 10,161,209 B1
(45) Date of Patent: Dec. 25, 2018

(54) OILFIELD DOWNHOLE/WELLBORE SECTION MILL

(71) Applicant: WELLBORE FISHING & RENTAL TOOLS, LLC, Houma, LA (US)

(72) Inventor: David L. Hutchinson, Houma, LA (US)

(73) Assignee: WELLBORE FISHING & RENTAL TOOLS, LLC, Houma, LA (US)

( * ) Notice: Subject to any disclaimer, the term of this patent is extended or adjusted under 35 U.S.C. 154(b) by 278 days.

(21) Appl. No.: 15/050,158

(22) Filed: Feb. 22, 2016

Related U.S. Application Data

(60) Provisional application No. 62/119,136, filed on Feb. 21, 2015.

(51) Int. Cl.
*E21B 29/00* (2006.01)

(52) U.S. Cl.
CPC ..... *E21B 29/005* (2013.01)

(58) Field of Classification Search
CPC ..... E21B 29/002; E21B 29/005; E21B 10/322
See application file for complete search history.

(56) References Cited

U.S. PATENT DOCUMENTS 2,899,000 A * 8/1959 Medders ..... E21B 29/002 166/55.8
5,265,675 A * 11/1993 Hearn ..... E21B 10/322 166/297
5,732,770 A * 3/1998 Beeman ..... E21B 10/322 166/55.8
6,920,923 B1 * 7/2005 Pietrobelli ..... E21B 29/005 166/55.2
9,187,971 B2 * 11/2015 Hutchinson ..... E21B 29/005
2010/0006290 A1 * 1/2010 Saylor, III ..... E21B 31/16 166/298
2013/0292108 A1 * 11/2013 Hutchinson ..... E21B 29/005 166/55.8
2014/0246236 A1 * 9/2014 Radford ..... E21B 10/322 175/40
2015/0354306 A1 * 12/2015 Fuller ..... E21B 29/005 166/285

FOREIGN PATENT DOCUMENTS

WO WO-2009135116 A2 * 11/2009 ..... E21B 10/322

* cited by examiner

*Primary Examiner* — Jennifer H Gay
(74) *Attorney, Agent, or Firm* — Garvey, Smith & Nehrbass, Patent Attorneys, L.L.C; Seth M. Nerhbass; Julie R. Chauvin

(57) ABSTRACT

The present invention provides a section mill/casing cutter/stabilizer apparatus and method featuring a segmented body that allows different pressure actuated sequences of extending stabilizer blades and cutting blades to cause the cutting and milling of wellbore casing and other debris in a wellbore. Applied pressure results in the flow through a flow restriction that creates a force on return springs associated with the centering and the cutting blades. The segmented body allows the manipulation of the blades and centralizers as needed. The spring returns a mandrel to the original retracted or run-in position on cessation or reduction of flow. The ability to vary the segments and sequences makes it easier to run the apparatus in conjunction with other milling and cutting tools, enhancing their performance through centralization and enlarging of cutting capacity.

36 Claims, 24 Drawing Sheets

OILFIELD DOWNHOLE/WELLBORE SECTION MILL

CROSS-REFERENCE TO RELATED APPLICATIONS

Priority of U.S. Provisional Patent Application Ser. No. 62/119,136, filed 21 Feb. 2015, hereby incorporated herein by reference, is hereby claimed.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

This present invention relates generally to the energy sector of gas and petroleum exploration and production, particularly to subsurface wellbore equipment and more particularly to an apparatus for the milling and cutting of tubulars (e.g., casing) with a tool body that is rotatable with a drill or work string as it centers and stabilizes itself within the wellbore.

2. General Background of the Invention

Oilfield wellbores can be made up and maintained through a series of tubulars (e.g., casings). These casings normally extend to the bottom of the wellbore in several positions or in multiples, wherein the larger casing encapsulates a smaller casing. In some instances, there can be two or three casings, each encapsulated by a larger casing. These multiple casings can be eccentric to each other. These casings can have concrete or cement pumped between them to prevent bottom hole pressure from penetrating to the surface. The maintaining and management of these casings are of vital importance throughout the life of the well.

The integrity of the casing can be breached by collapse or corrosion. In such a case, they must be repaired. The collapsed or corroded section must be removed. Appropriate repairs are then performed. It is this procedure of removing existing damaged casing that this present invention entails.

This is a blind operation in the sense of not being able to see the procedure as it is happening. Other indicators must be used to do this operation properly. Weight indicators and pump pressures along with the knowledge to read these types of measurements are needed.

The operation and centralization of the tool apparatus of the present invention is conducted down hole wherein rotation of the tool body rotates one or more blades that cut the casing. In some instances only one casing is removed, which could be the innermost, smallest casing. When the device is sent to mill out the innermost casing, it should not cut and mill beyond the dimensions of the innermost casing. Damage to the integrity of the larger casing that is encapsulating this smaller casing should be avoided.

In some wellbore situations, the second innermost casing is milled, typically after the first innermost casing has been milled. A tool must have the ability to be setup to perform the same procedure as it did in the innermost casing but still maintain the ability to traverse through the inner diameter of the innermost casing.

Centralization of the tool body is perfected in most situations involving operations in casing. Centralization of the tool body can be more difficult if having to pass through a smaller internal diameter casing or some other form of restriction. The length of centralization to stabilize and centralize a tool is beneficial, in the milling or cutting operation.

The following U.S. Patents and U.S. Patent Application Publications are incorporated herein by reference (as are all references to which they refer): U.S. Pat. Nos. 2,899,000; 5,732,770; 9,187,971; 2013/0292108.

SUMMARY OF THE INVENTION

This present invention provides a tool body having a mill/casing cutter/stabilizer and can feature a segmented body that allows different pressure actuated sequences. These sequences extend stabilizer blades and cutting blades to perpetuate the cutting and milling of wellbore casing and other debris in a wellbore. A sequence can be manipulated to have stabilization below and/or above the designated cutting blades position.

Debris could be anything in the wellbore that is not supposed to be there. Debris can range from something dropped in the wellbore from on top to parts of other tools in the wellbore such as packers, shoes, subs etc. Sometimes other milling operations that took place caused tools or parts of tools to drop further down the wellbore and now it has to be dealt with in the present operation; thus, in general, it is called debris.

The present invention uses pump pressure of fluids through the inner diameter of the work string creating pressure on a piston that engages and extends cutting knives and stabilizer blades. These blades enable a cutting or milling of casing and/or any debris in a wellbore. The piston is returned to an idle position on the cessation of flow, by a return spring. The stabilizers and cutting knives retract into their respective bodies when the piston returns to its initial position. Carbide cutting elements can be applied to cutting knives to be able to cut or mill away the casing or debris. Actuation of blades and stabilizers can be achieved by pushing of a heel portion of the blade/stabilizer against a shoulder on piston.

This present invention can be manipulated to mill up or mill down. This present invention can also be used as a centralizer and stabilizer for other down hole oilfield tools that would be aided with centralization. For example, the present invention could be used as strictly a centralizer or stabilizer for other conventional tools that are run in the wellbore. There are other types of cutters and mills and overshots that when run in the wellbore, would be aided by a tool to centralize it. So, the present invention could be set up as a centralizer in these cases.

The present invention provides a unique design of knives and stabilizers that simplify the extension of the knives and the stabilizers to a larger horizontal position, attached to the body and held in position by pins. The sequential operation is achieved through a piston that moves between first and second positions. The tool body can have segmented bodies, which at least one segment with a deviated pin location, can cause a sequential operation.

DETAILED DESCRIPTION OF THE INVENTION

The following description is not limited to these prescribed details but is exemplary of a preferred embodiment of the present invention. The general principles of the invention and purposes of the invention as illustrated are best defined by the appended claims.

Figure 1:
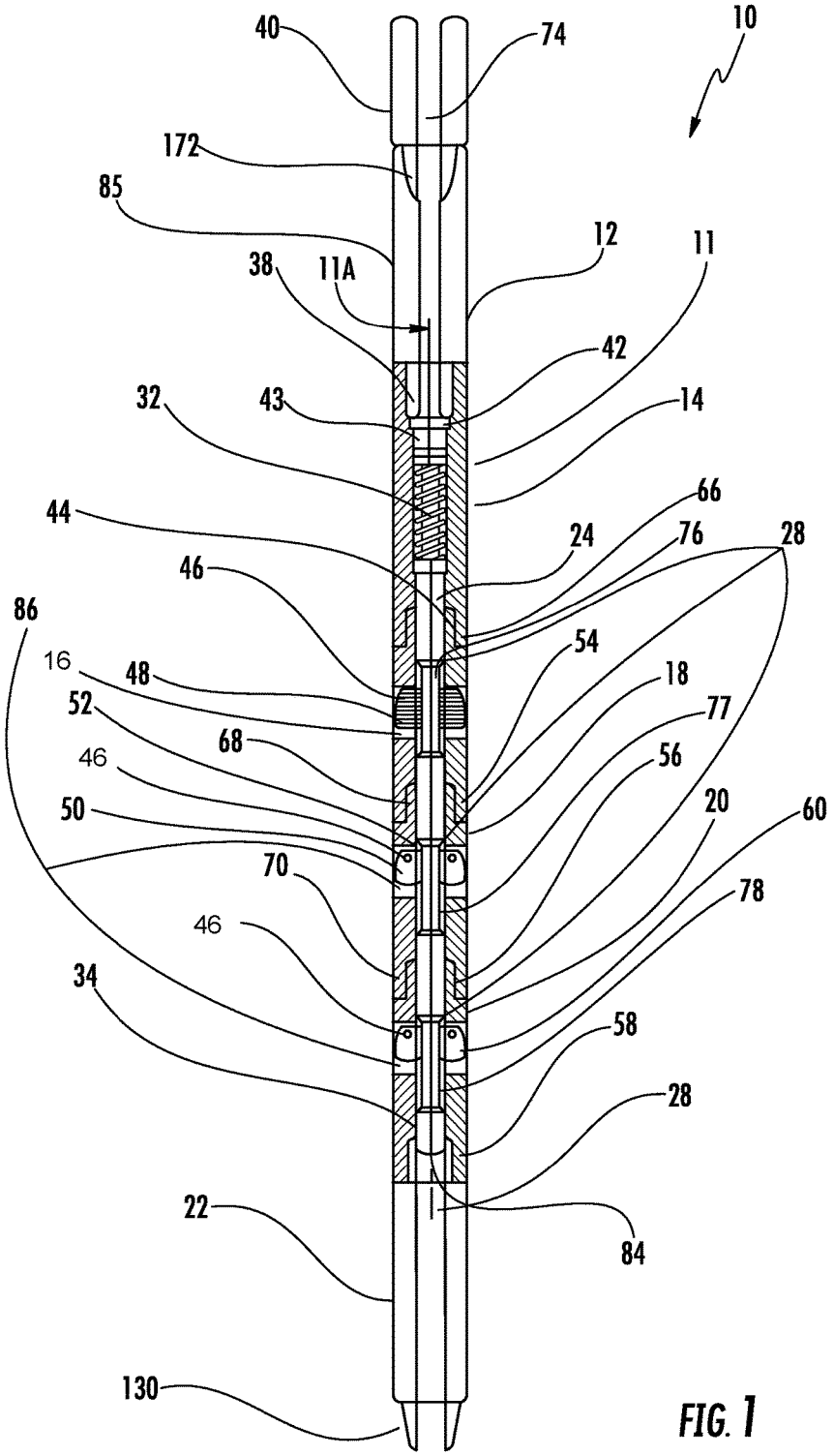
FIG. 1 is a longitudinal sectional view of a preferred embodiment of the apparatus of the present invention showing the tool body, with all blades and centralizers in retracted positions.
Figure 2:
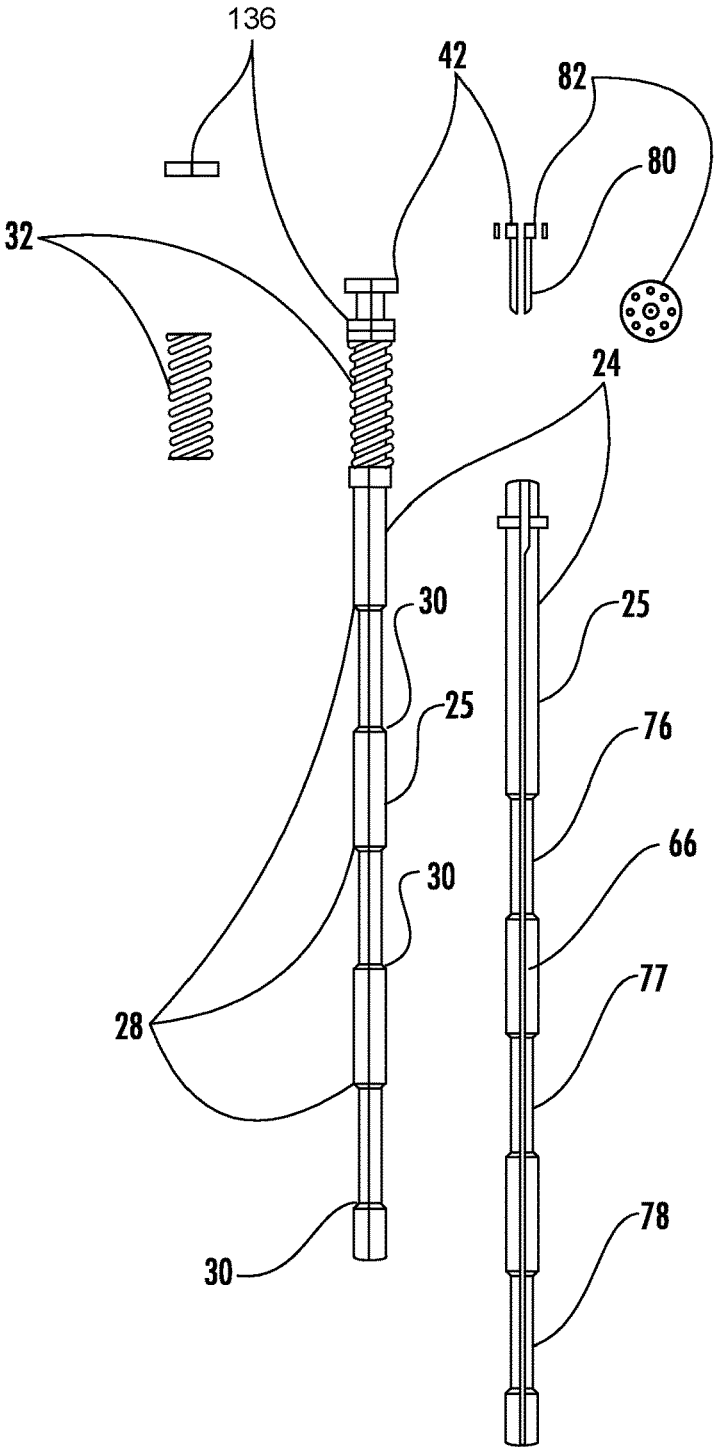
FIG. 2 is a partial longitudinal sectional view of a preferred embodiment of the apparatus of the present invention showing the piston assembly.
Figure 3A:
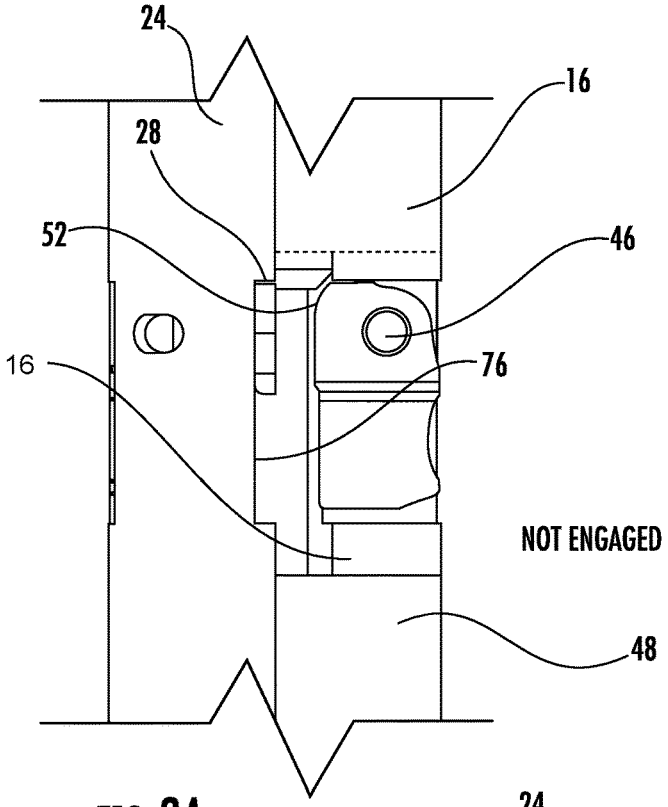
FIG. 3A is a fragmentary longitudinal sectional view of a preferred embodiment of the apparatus of the present invention showing the cutter blade and piston in a retracted position.
Figure 3B:
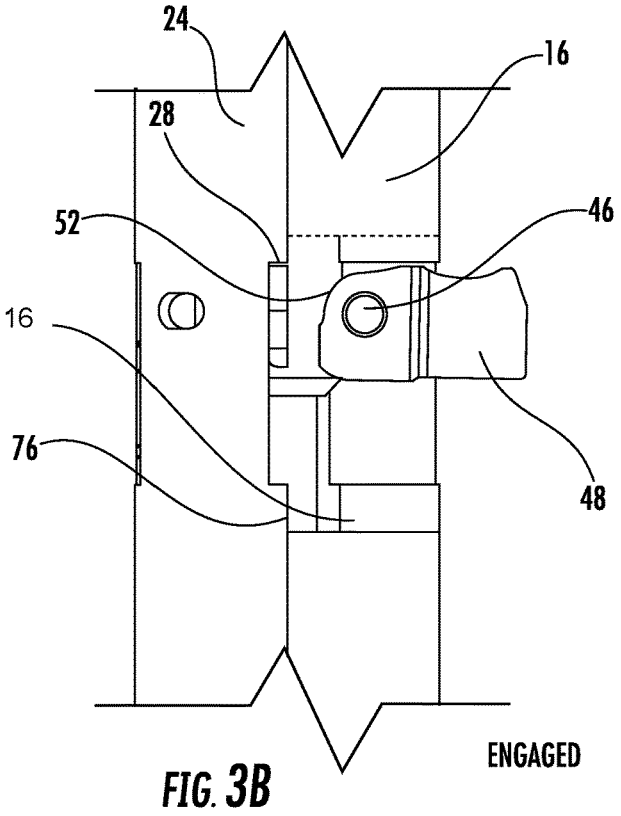
FIG. 3B is a fragmentary longitudinal sectional view of a preferred embodiment of the apparatus of the present invention showing the cutter blade and piston in an extended position.
Figures 4A, 4B, 4C:
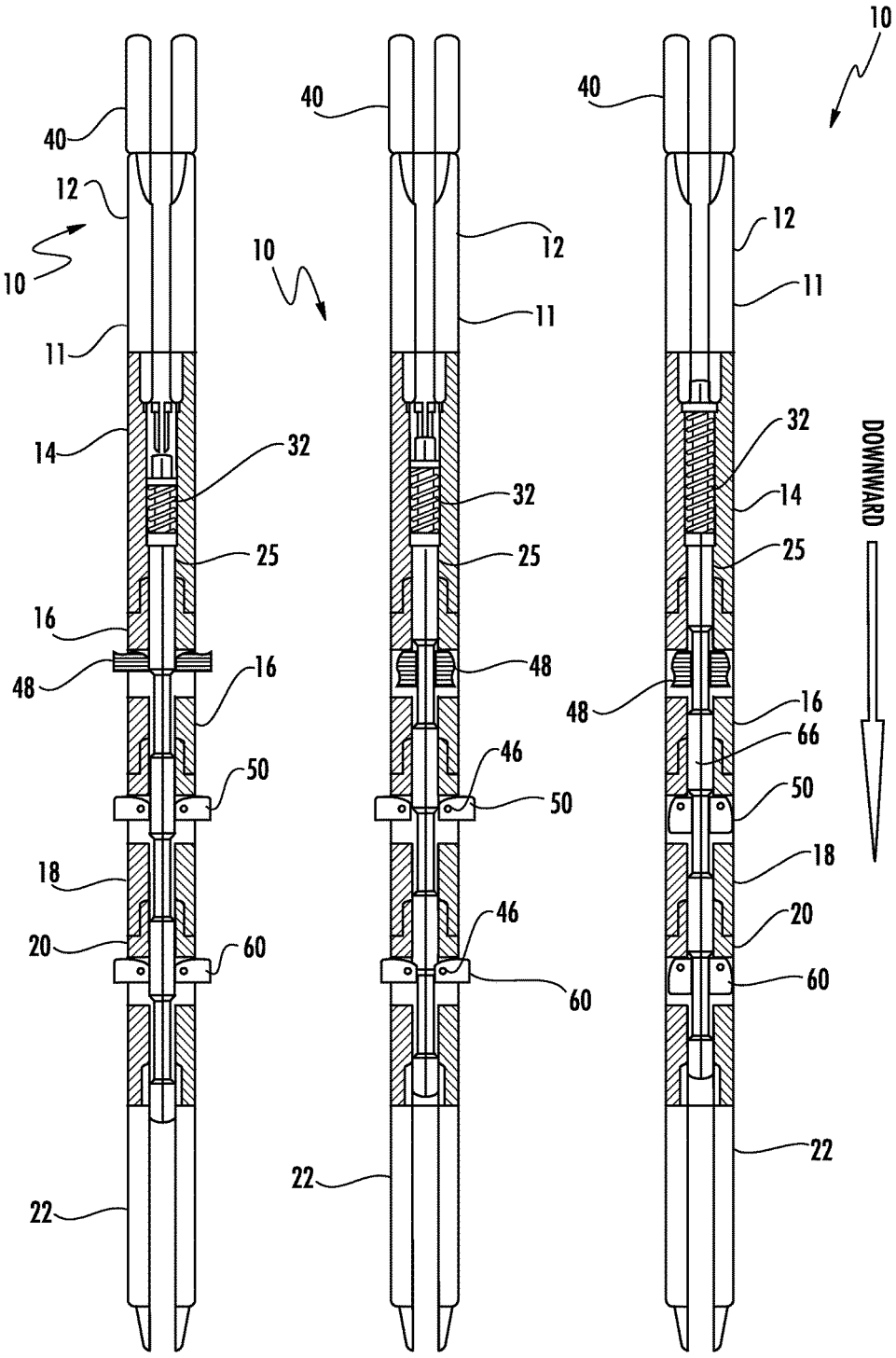
FIG. 4A is a longitudinal sectional view of a preferred embodiment of the apparatus of the present invention showing the tool body, blades and parts of the present invention with blades retracted.
FIG. 4B is a longitudinal sectional view of a preferred embodiment of the apparatus of the present invention showing the tool body, blades and parts of the present invention with centralizer blades.
FIG. 4C is a longitudinal sectional view of a preferred embodiment of the apparatus of the present invention showing the tool body, blades and parts of the present invention with both the centralizer blades and cutter blades engaged.

Broadly, a preferred embodiment of the apparatus 10 of the present invention, provides a wellbore down hole tool with a segmented tool body 11, (FIG. 1) that can be (by manipulating the segments, 16, 18, 20 (segments 18 and 20 can be the same, as shown in FIG. 1)) set up as a tool for a variety of versions for centralizing and stabilizing, as well as cutting and milling casing 26 or debris in an oilfield wellbore 36 that has been cut in formation 44, and in a sequential event. The segmented tool body design allows for many variations of setup that will aid the operation of the tool. The segments can be interchanged, added to, and configured to maximize the hole situation.

In a preferred embodiment of the present invention, the segments can be the same length and have the same connections so that they can be interchanged. In a preferred embodiment of the present invention, the cutter segments 16 and the centralizer segments 18, 20 can be put in any order, and the sequence of centralization first and cutter extension following will always work. In an embodiment of the present invention, the cutter segment 16 can be placed on the bottom, top, or middle, and the sequence of centralization first and cutter extension following will remain the same.

For example, in the event there was a lot of footage to mill and after making the initial run, cutting out and milling a certain amount of footage, then on the second run, the tool could be set up with two segments of knife blades and after the first one was worn out, the second would be in place to double the milling time. Another advantage of the segmented tool body is that centralization can be extended below a cut by adding more segments. A preferred embodiment of the present invention is similar to a 2 blade or 4 blade marine cutter or casing cutter. A preferred embodiment of the present invention is also similar to a section mill (which is usually piston driven). FIGS. 1, 4A-4C, 5, 8A and 9 show a preferred embodiment of the apparatus of the present invention, designated generally by the numeral 10.

Down hole cutter tool apparatus 10 includes multiple sections 12, 14, 16, 18, 20 and 22.

In one embodiment of the present invention, actuation of blades 48 and stabilizers 50, 60 can be achieved by pushing of a heel portion of the blade 48/stabilizer 50, 60 against a shoulder 28 on piston 24. In one embodiment of the present invention, the piston pusher shoulders are all preferably the same length.

Section 12 is an upper section or top bushing that connects to a drill string or work string 40 at connection 172 (e.g., threaded connection). Upper section or top bushing 12 connects to piston housing or piston section 14. Top bushing 12 connects to piston section 14 with connector 38 (e.g., threaded connection). Piston housing or section 14 has piston assembly 24 that carries the seal 43. Seal 43 enables the fluid pressure to be generated to cause downward thrust that will be used to manipulate the prearranged alignment of following segments 16, 18, 20 to cause the sequential actions (FIGS. 4A, 4B, and 4C, for example) desired to be completed.

Drill string 40 enables rotational force to tool body 11. Set weight from the upper elements in the drill string 40 can be applied to the tool body 11, in the wellbore 36. Drill string 40 annulus 74 is the source of the fluid pressure that is used to manipulate the centralizers, 50, 60, stabilizers 50, 60 and cutter blades 48 based on the segmented parts positioning. Another section positioned is the lower most section 22, used to then connect to further tubular bodies in the wellbore below the tool body 11. Such other tubular bodies can extend the work string 40 below the cutter tool of the present invention to be able to place some type of mill or even a stabilizer further down the wellbore. This would be part of the bottom hole assembly that the operator would feel would aid in the operation.

As illustrated in FIG. 1, the top bushing 12 and then the piston housing segment 14 are joined by a preferably threaded connection (e.g., mating threads) 38. Stabilizer segments 18, 20 and knife segments 16 are made up in a predetermined alignment and number and are dressed with the appropriate stabilizer blades 50, 60 or knives 48 as prescribed by the desired action that an operator would want to perform.

Tool segment 16 has knife blades 48 and is attached to the lower portion of the piston segment 14 in FIG. 1. Tool segment 18 has centralizer blades 50 and is attached to the lower portion of the stabilizer tool segment 16. A preferred embodiment of the present invention preferably includes 4140 or 4145 heat treated carbon steel grade parts, though cutting blades 48 are preferably made of 4140 HT steel and centralizer blades 50 are preferably made of 4140 HT steel, for example.

In an embodiment of the present invention, each knife blade 48 has a cut out edge (outer edge) and a mill down edge (inner edge). In the operation of the tool, the casing 26 is whole and the knives 48 are run retracted in the body. The fluid pressure activates the knives 48, they engage the inner wall of the casing 26, and as they pivot outward on pins 46, the edge of the knife 48 coming out of the cutter body would be the "cut out" edge of the knife 48. This is where the cutter blade 48 would cut through the casing 26 as it pivots into the cutting position. This was done by what we are calling using the cut out edge of the knife or the "cutting up". Then once the knife 48 has been fully extracted through the casing, the milling operation, cutting down, with the other edge of the blade, is put into motion. Thus we "cut out" with one edge (the outer edge) of the blade 48 and then "cut down" with the other edge (the inner edge) of the blade. There is no need for a difference in the material used for each edge—knife 48 can be unitary—one edge of the blade can be used to cut out, and the other edge can be used to cut down. Typically one can mill down 20-100 feet using the tool with the dimensions described below before knife 48 is worn out.

Knife 48, hinged to the body by pin 46, pivots from the unengaged position, to the engaged position, when piston 66 is moved downward. For the knife 48 to be able to cut the casing, it has to pivot to a position perpendicular to the body. This causes it to cut through the casing 26. The cutting through the casing is done on one edge of the knife, and could be described as the blade "cutting up", because that would be the motion of the knife as it pivots out, an upward pivot. Then when it is in that position, then one is able to mill down, "cut down". This is all done with the work string 40 in rotation, and thus the whole tool in rotation. The pump pressure is what is driving the knives 48 out, and as they are being driven out, they are cutting "upwards". Then after they are fully cut out, then while still rotating the work string 40, one lowers the whole work string 40, and the cutter knives 48, engaging the casing 26 on the other edge of the blade, are "cutting down".

Another tool segment 20 has centralizers and is attached to the upper centralizer segment 18. An important element of the equal length stabilizer tools segments 18, 20 and the knife blade segments 16, is that the pivot pins 46 are a distance further on the knife blade segment 16 than the stabilizer blade segments 18, 20. This spacing is to allow the action of the piston 66 to manipulate the stabilizers 50, 60 and knives 48 in a sequence. The sequence first stabilizes and centralizes the tool body 11 before beginning the cutting action of the knife blades 48. This sequence of first stabilizing and then cutting is particularly important if a section in a section is going to be done and through a restriction. By aligning the centralizer segments 18, 20 and knife segment 16 differently, a sequence can be manipulated accordingly. The centralizers (segments 18, 20) maintain centralization during the cutting action. The centralizers more surely centralize the tool body 11.

FIGS. 2, 10A-10C, 20 and 23 show piston assembly 24 of the tool in the form of a one-piece elongated, cylindrical mandrel 25. The mandrel 25 is hollowed, having bore 27 to allow regulated fluid to pass through via bore 27. On the top of the mandrel 25 is a machined hollow portion to receive a flotel 42 or fluid flow restriction device (see FIGS. 2 and 11-16). The flotel 42 can be cylindrical and is positioned in the top portion of the mandrel 25. The flotel 42 has a stem 80 that mates with the top of the mandrel 25. The flotel 42 is used both to restrict and regulate the fluid pressure so that mandrel 25 moves downward responsive to the pressure, and so that it exceeds the length of the stem 80 on the flotel 42 wherein a noticeable pressure drop is realized. This would also be an indication to an operator that the mandrel 25 has pushed the centralizers 50, 60 to an extended position (see FIG. 4B) and cutting blades 48 (see FIG. 4C) fully out of the segments 16, 18, 20 and achieved the operation of both centralization and extension of the cutting blades 48 into engagement with the casing 26 (see FIGS. 4C and 5). The flotel 42 also has multiple (e.g., six to eight) holes 82 in its top surface to allow fluid to press against the mandrel 25 at packing member seat 45.

Flotel 42 can have a carbide jet placed in its central opening 51. The jet is used as a fluid restriction and by using carbide the jets seem to last longer and work better. When fluid pressure is first initiated, flow is only through the center of flotel 42 (see FIG. 12) until the piston 24 assembly is pumped down enough distance to clear the stem of the flotel 42 and allow the fluid pressure to "dump" through the increased area of flow (see FIG. 13). Before that "dump", there is a very concentrated pressure flow and thus a replaceable jet is best used. Such replaceable jets are commercially available from Kennametal Inc. of Latrobe, Pa. (http://www.kennametal.com/).

In an embodiment of the present invention, pump pressure is applied and hydraulics are able to be applied through the work string 40 to the cutter. Preferably, the flow comes to the flotel 42 that acts like a restrictor. The pressure preferably flows through the ports 82 in the flotel 42 and preferably works against the seal 136 on the piston 66. The piston 66 then preferably moves downward because of the flow, collapsing the spring 32 and ultimately engaging the knife blades 48. In an embodiment of the present invention, the restriction of the pressure preferably notifies the operator of the tool 10 that the knife blades 48 have not been fully extended because the operator does not see a pressure drop.

In an embodiment of the present invention, if the pump pressure has overcome the piston 66 and has preferably driven it downwards fully, the pump pressure is then preferably able to escape through the relief area created by the flotel 42 no longer extended through the piston 66. Thus, the knife blades 48 would then preferably surely be extended, and the operator would then preferably see a real pressure drop in the hydraulics. This signals that the tool 10 has gone through the necessary steps to perform the cutting operation.

The mandrel 25 has a number of spaced apart elongated recesses 76, 77, 78 (areas of reduced diameter) which are preferably all of the same length. Mandrel 25 has bevels 28, 30 on each end of a recess 76, 77, 78. The bevels 28 on the mandrel 25 are used to extend the centralizer or stabilizer blades 50, 60 and the cutting knives 48 when the tools are made up for cutting down. Bevels 30 only function to transition from the large diameter portion of mandrel 25 to the small diameter portions 76, 77, 78, and are not used to deploy blades 48, 50, 60. When cutting up instead of down, piston assembly 24 would remain fully engaged by pump pressure and in a position that would hold knives 48 in cutting to allow cutting up. Cutting up is another term for milling up—the cut is made the same whether cutting up or cutting down, and one either raises the tool while milling if cutting up or lower the tool while milling if cutting down.

Bevels 28 and 30 are optional. There could be for example simply two diameters on piston 66, the outer and the inner, with no beveled transition. However, having bevels 28 makes the pivoting of blades 48, 50, and 60 smoother than if they were not there.

The centralizers/stabilizer blades 50, 60 and the cutting blades 48 have a contact radius area 52 on the upper inner portion of each blade of the blades 48, 50, 60 in relation to an inline position with the segmented bodies 16, 18, 20. This is the area that the upper bevel 28 on the piston mandrel 25 makes contact with said blades 48, 50, 60, causing both the centralizer/stabilizer blades 50, 60 and the cutting blades 48 to extend outward generally perpendicular (or at acute angles) to the segments or sections 16, 18, 20 or central axis 11A (see FIGS. 3A, 3B, 4A, 4B, 4C, 5, 8, 9, and 25-29). There will be a sequence based on the position of the cutter knife body segments 16 as the bevels 28 will initially extend blades 50, 60 in the centralizer blades segment 18, 20, and as the mandrel 25 continues to move downward, it extends the cutting knives 48 outward perpendicular to the segmented bodies 16, 18, 20. This sequence allows the cutter apparatus 10 (FIG. 1) to first be centered in casing section 26 before extending the cutter knife blades 48 to perform the task of cutting, milling, or parting the casing 26 or milling debris that might be contained within the casing 26 inner diameter.

The outer diameter of the tool body 11 can vary, and the inner diameter of the restriction may dictate the size of the tool body 11. For example, a preferred embodiment of the present invention includes an outer diameter of preferably 3¾ inches to 10½ inches. One embodiment of the present invention in which the outer diameter is 3¾ inches allows for cutting of casing of preferably about 5 inches to 7 inches. Another embodiment of the present invention in which the outer diameter is 4¾ inches allows for cutting of casing of around 9⅝ inches, for example.

One embodiment of the present invention has tool body 11 with an 8¼" OD to cut for example 9⅝"-16" ID casing. In such a case, tool body 11 could have, for example, the following dimensions and made from the following materials:

Total length of tool body 11—about 14 feet and made out of 4140 HT steel.

Length of each tool segment 16, 18, 20—about 30" and made out of 4140 HT.

Outer diameter of piston assembly 24—about 3" and made out of 4140 HT.

Inner diameter of piston assembly 24—about 1" and made out of 4140 HT.

Force of spring 32—about 400 PSI.

Length of spring 32—about 17¼" and made out of spring steel (commercially available from Schlindler Spring (http://schindlerspring.com/) as Schindler Part #825-SNS-10.

Outer diameter of spring 32—about 4¼".

Diameter of flotel 42 (larger)—about 5" and made out of 4140 HT.

Holes 82 in flotel 42: number of holes 8 and diameter of each about ¾".

Diameter of central opening 51 in flotel 42—about ½".

Replaceable carbide jet 59 placed in central opening 51 of flotel 42—about 1" long by ⅜" in diameter, preferably a series 70 bit nozzle commercially available from Kennametal Inc. of Latrobe, Pa. secured in opening 51 in flotel 42 with a snap ring or a threaded carrier.

Outer diameter of O-ring 41—about 2".

Length of stem 80—about 3½" and made out of 4140 HT.

Outer diameter of seal 136—about 5" and made out of rubber (commercially available from Blue Water Rubber and Gasket (http://www.bluewaterrubber.com/) as a 5" O-ring).

Length and width of cutter blade 48—about 2" by 8" and made out of 4140 HT.

Length and width of stabilizer 50, 60—about 1½" by 8" and made out of 4140 HT.

Length of each recess 76, 77, 78—about 10".

In a preferred embodiment of the present invention, the pin placement on the stabilizer segments 18, 20 is preferably about 8 inches from the bottom of the stabilizer segments 18, 20. In a preferred embodiment of the present invention, the pin placement on the knife segments 16 is preferably about 10 inches from the bottom of the knife segments 16.

Figure 5:
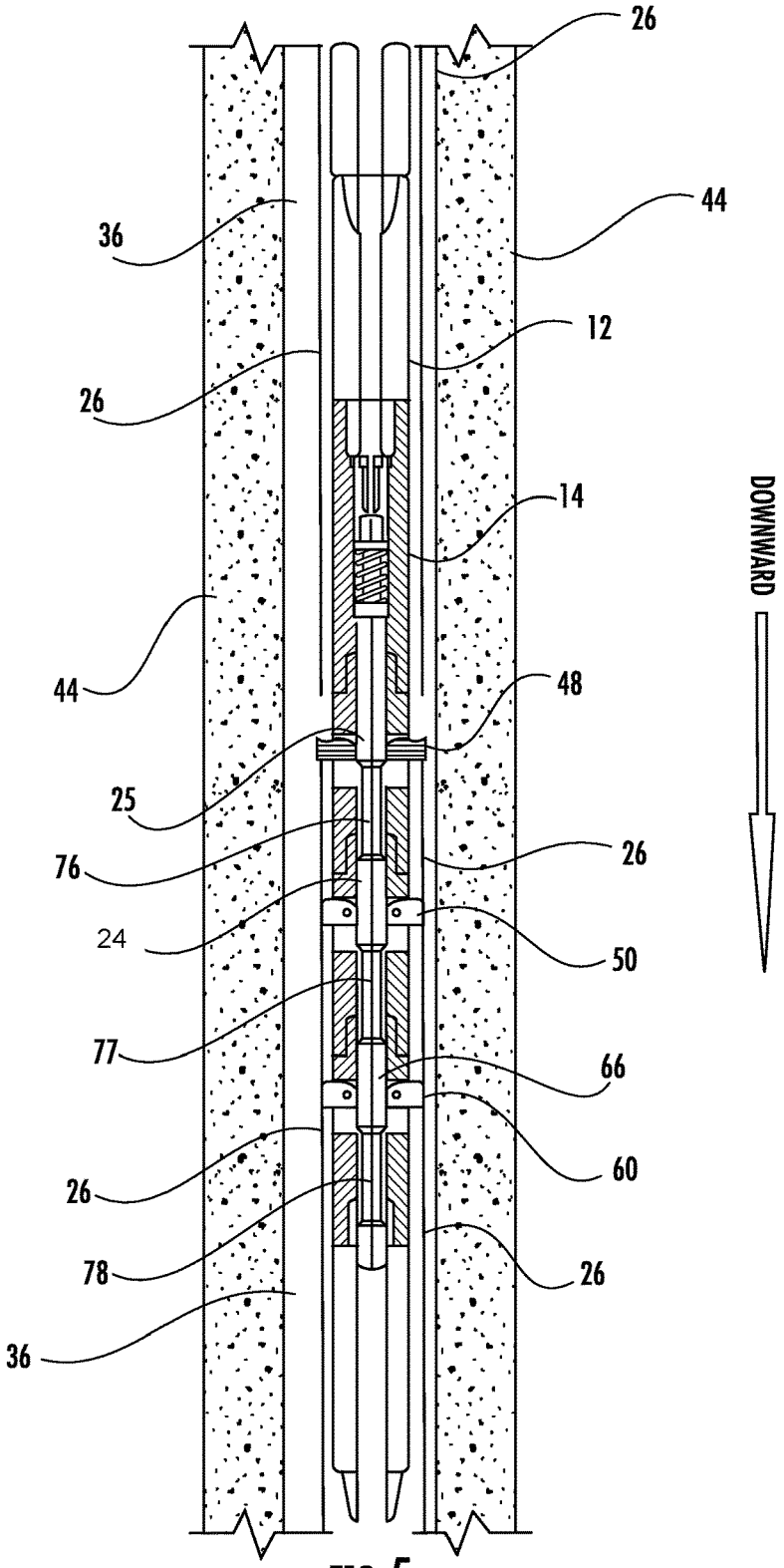
FIG. 5 is a longitudinal sectional view of a preferred embodiment of the apparatus of the present invention showing the present invention fully engaged in a down hole situation, positioned for cutting a section of casing.
Figure 6:
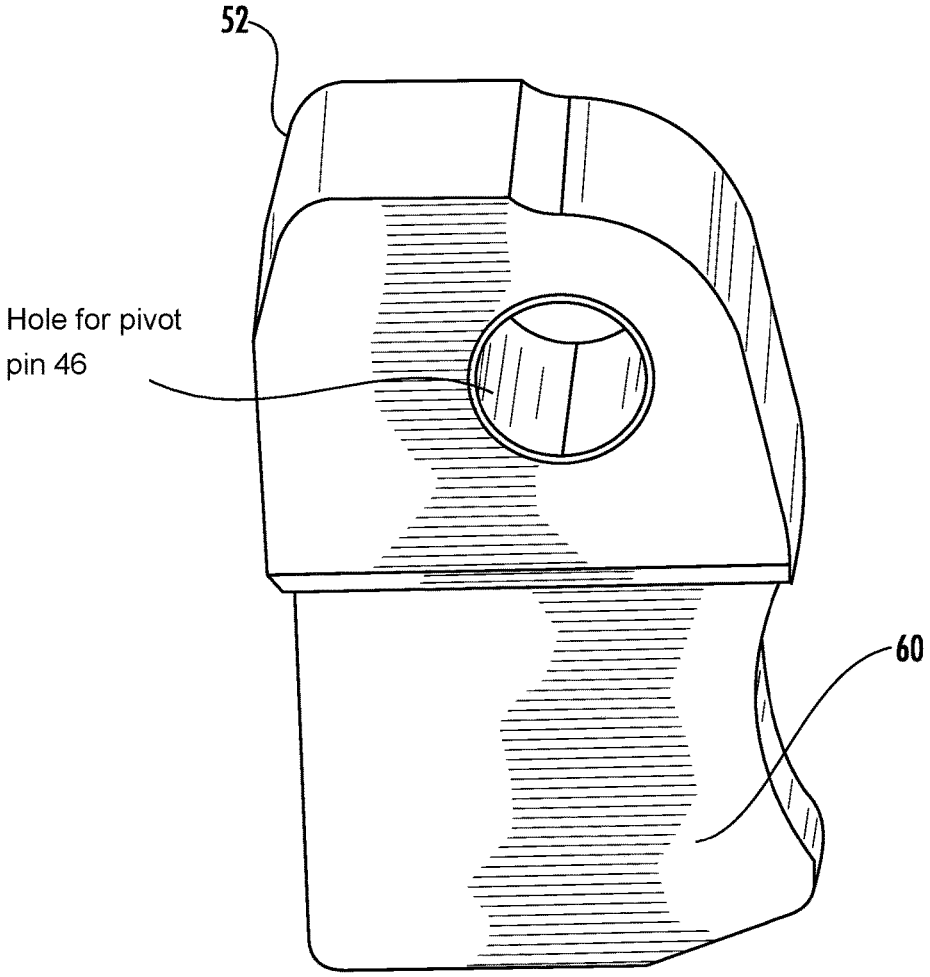
FIG. 6 is a fragmentary view of a preferred embodiment of the apparatus of the present invention showing a cutter blade, pin hole and heel of knife.
Figure 7:
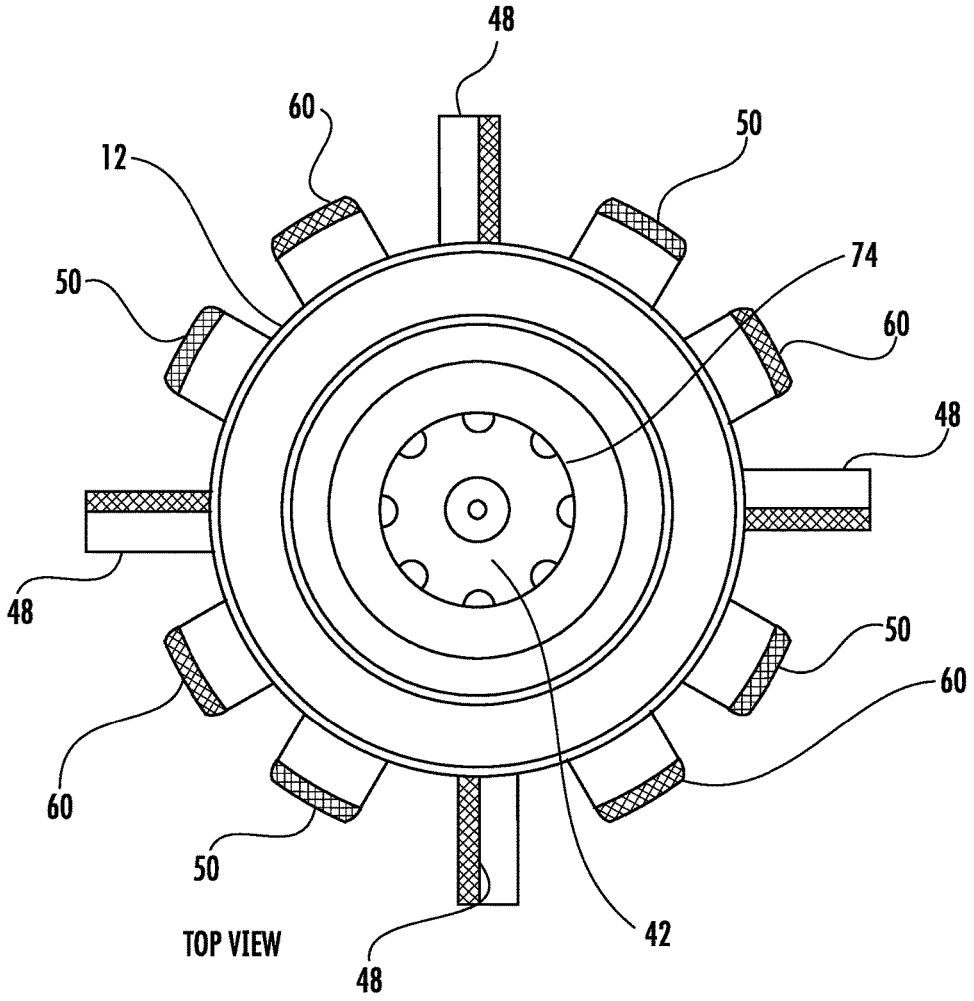
FIG. 7 is a partial top view of a preferred embodiment of the apparatus of the present invention showing all the blades and centralizers in fully engaged position.
Figures 8A, 8B, 8C:
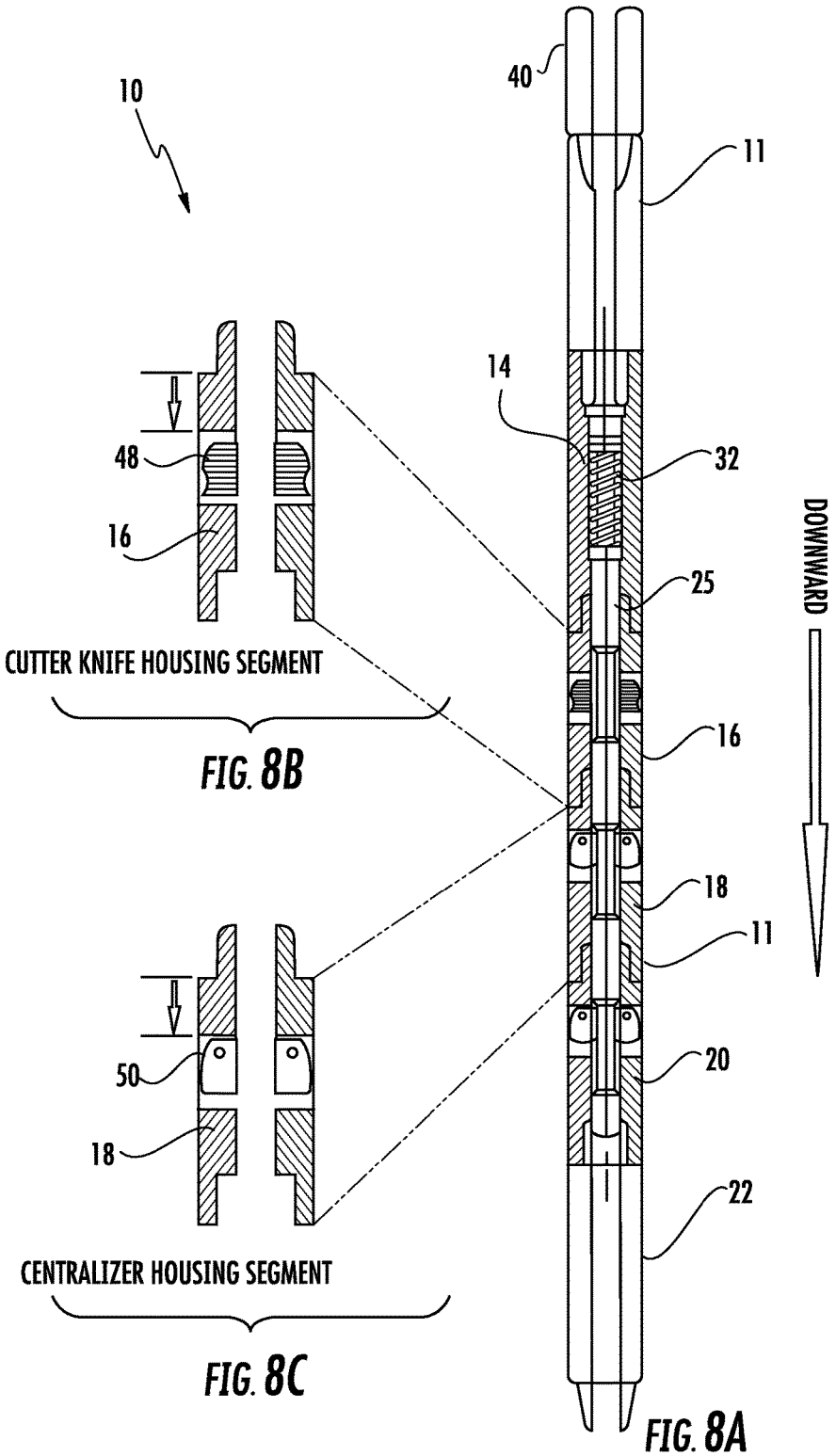
FIG. 8A is a longitudinal view of a preferred embodiment of the apparatus of the present invention.
FIG. 8B is a fragmentary view of a preferred embodiment of the apparatus of the present invention showing cutter knife housing segment.
FIG. 8C is a fragmentary view of a preferred embodiment of the apparatus of the present invention showing centralizer housing segment.
Figure 9:
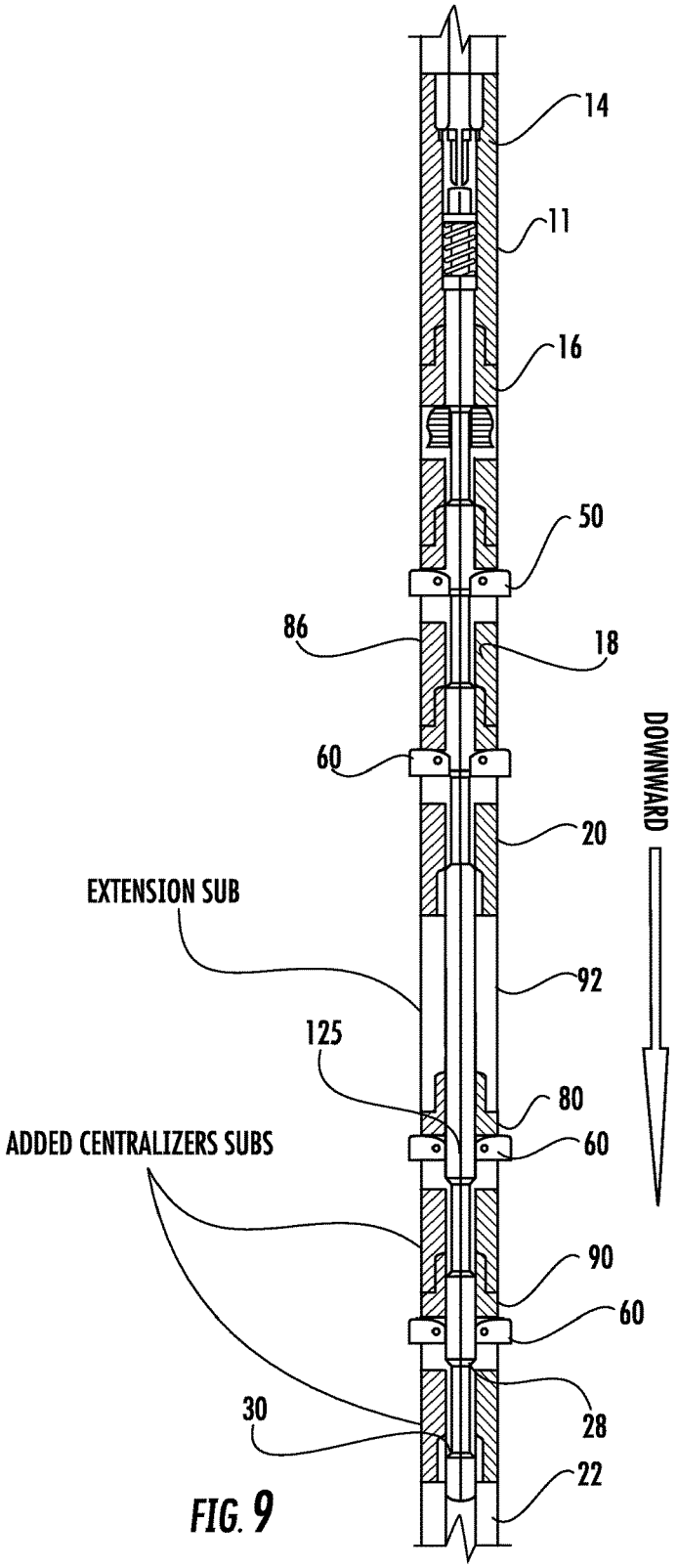
FIG. 9 is a longitudinal sectional view of a preferred embodiment of the apparatus of the present invention extending the centralizers.
Figures 10A, 10B, 10C:
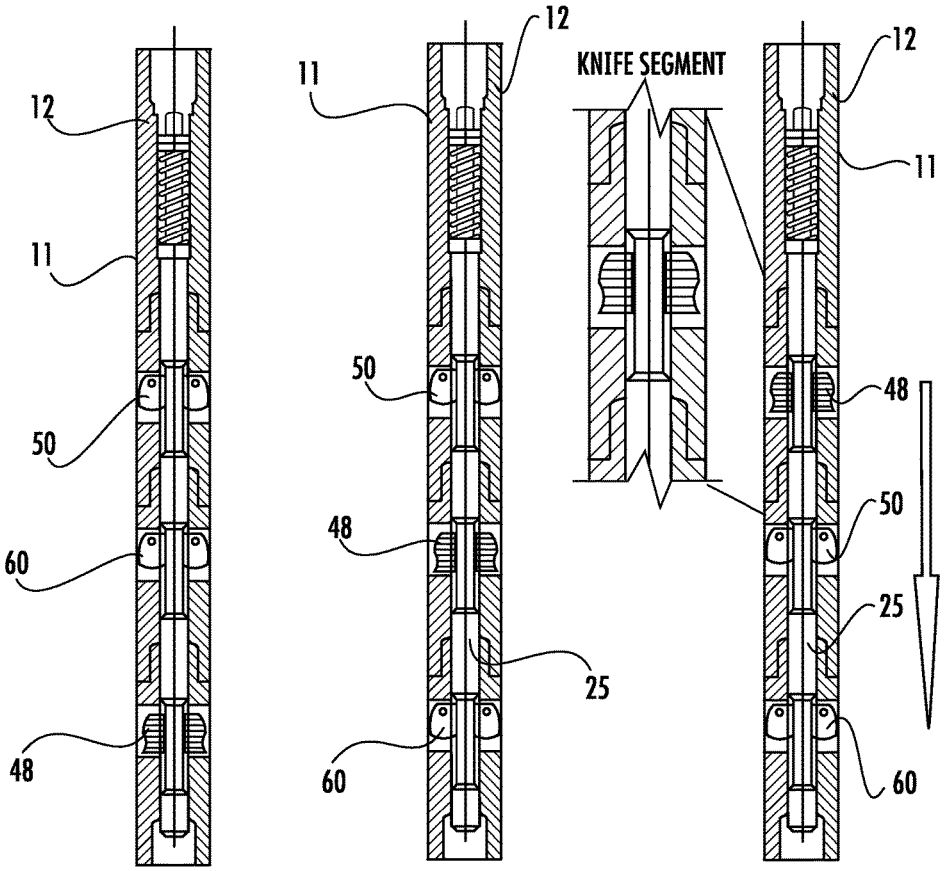
FIGS. 10A-10C are longitudinal sectional views of a preferred embodiment of the apparatus of the present invention with the knife body segment in various positions.
Figure 11:
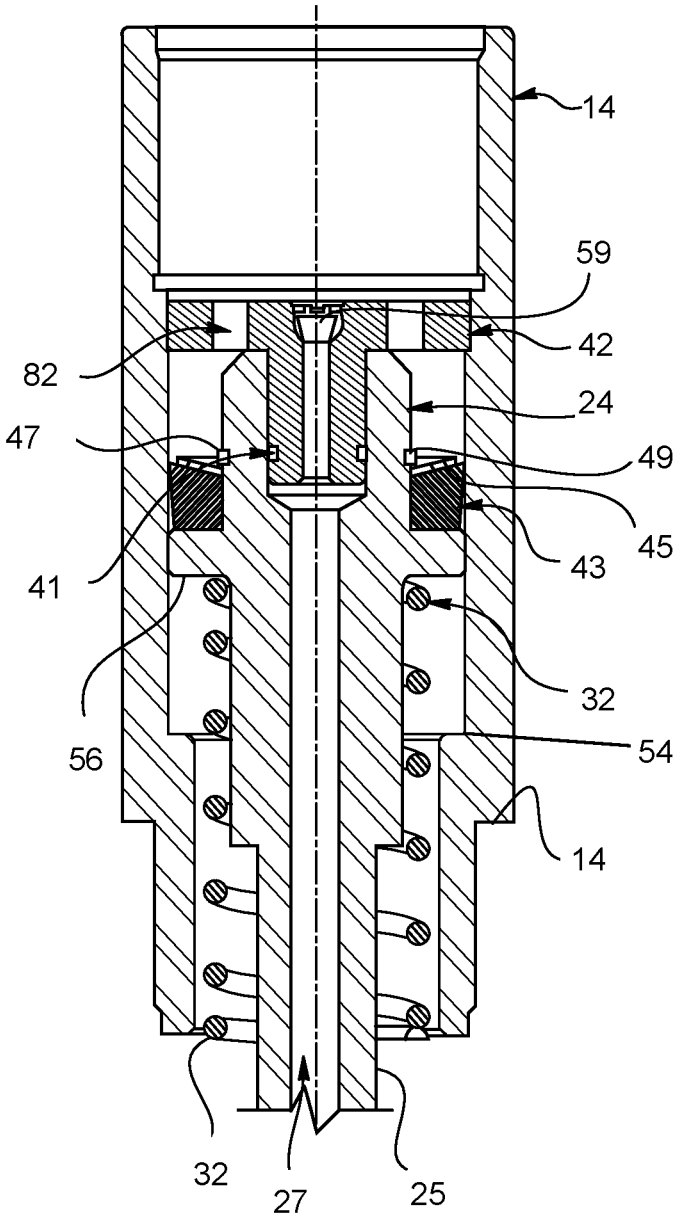
FIG. 11 is a partial sectional view of a preferred embodiment of the apparatus of the present invention.
Figure 12:
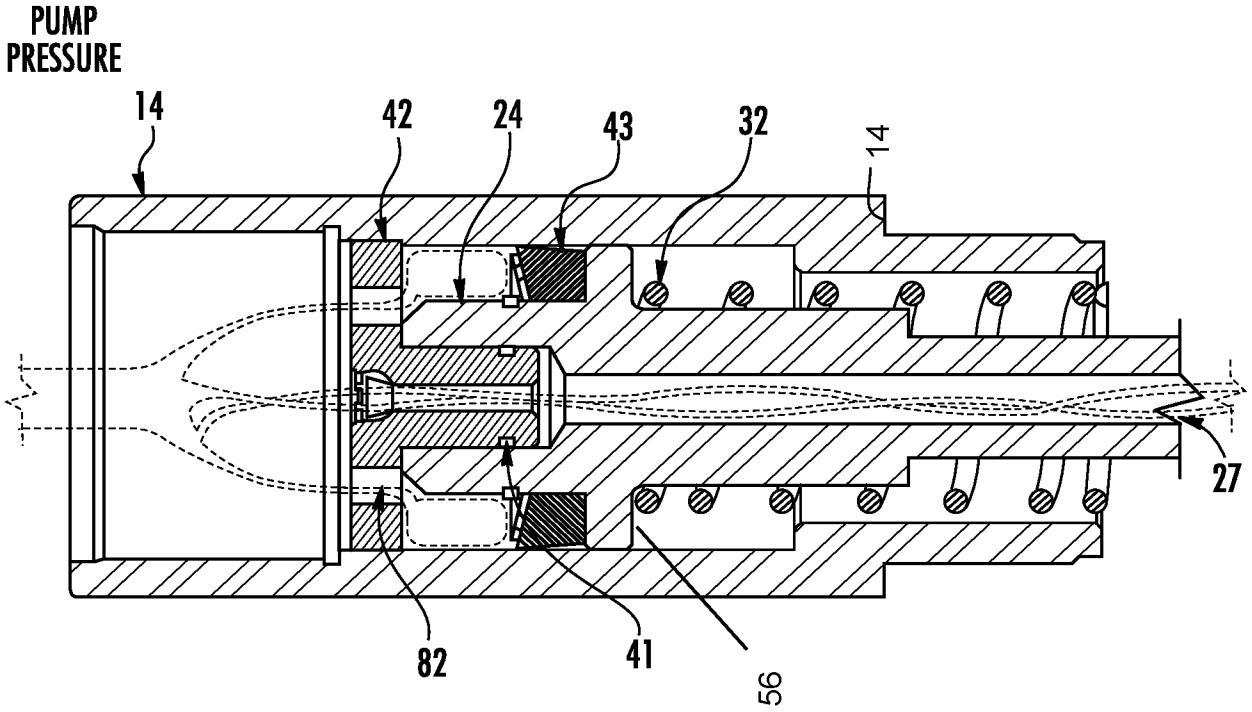
FIG. 12 is a partial sectional view of a preferred embodiment of the apparatus of the present invention.
Figure 13:
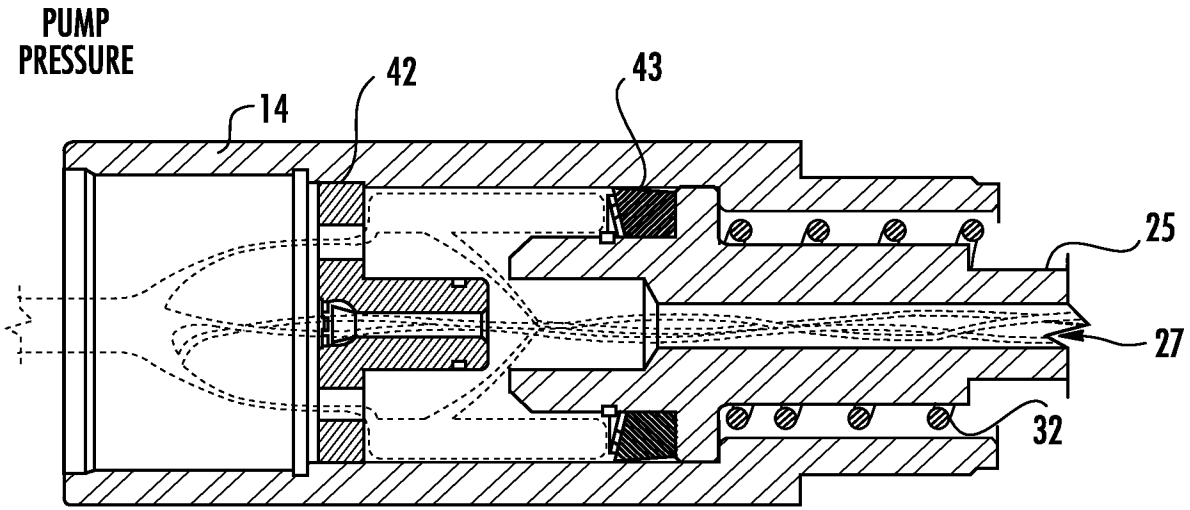
FIG. 13 is a partial sectional view of a preferred embodiment of the apparatus of the present invention.
Figure 14:
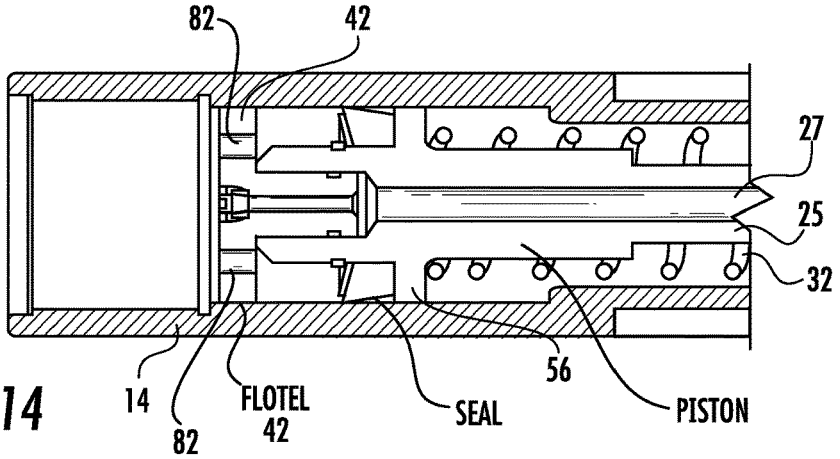
FIG. 14 is a partial sectional view of a preferred embodiment of the apparatus of the present invention.
Figure 15:
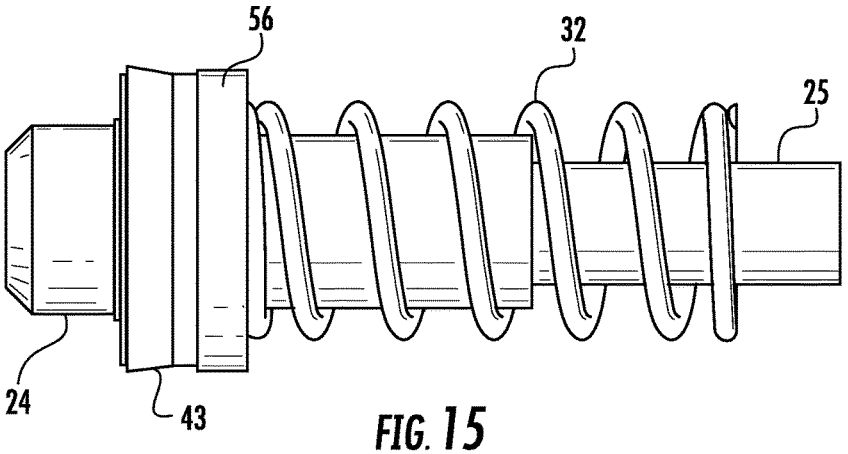
FIG. 15 is a partial view of a preferred embodiment of the apparatus of the present invention.
Figure 16:
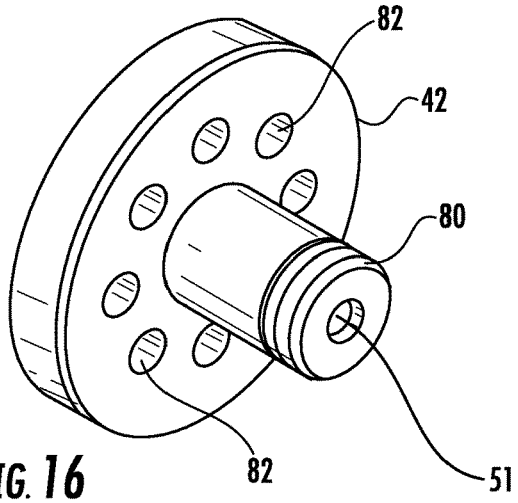
FIG. 16 is a partial perspective view of a preferred embodiment of the apparatus of the present invention showing the flotel.

The initiation of the tool 10 sequence starts with the tool body 11, lowered into a wellbore 36 (see FIG. 5). Once in position, pump pressure is provided by fluid pumped from the surface through the annulus 74 of the drill string 40. The fluid flows through the flotel 42, putting pressure on the mandrel 25 (see FIGS. 11-13). This causes downward pressure that builds up against the seal 43 of the mandrel 25, overcomes the retention spring 32, and moves the piston mandrel 25 downwardly. The bevels 28 on the mandrel 25, engage the contact radius area 52 of the blades 48, 50, 60, and manipulate the sequence of blades 48, 50, 60. Based on the positioning of the segments 16, 18, 20, the blades 48, 50, 60 are extended outward perpendicular to the segmented cutter bodies 16, 18, 20 and axis 11A and in the sequence of centralizer blades 50, 60 first and then knife blades 48. This is all being done after rotation of drill string 40 was begun by a top drive apparatus on the surface. Such rotation of tool body 11 also rotates the blades 48, 50, 60 to perform the functions of centralizing and cutting of casing 26 (or any wellbore debris).

If a window is desired, as both torque from the drill string 40, and pressure from the fluid is being pumped through the annulus 74, the drill string 40 can be slowly lowered downward thus cutting a window in the casing 26 that the tool body 11 (FIG. 1) is centered up to.

Upon cessation or reduction of fluid pressure and the weight of the lowered work string 40, the inner spring 32 in the piston housing 24 returns all the blades 48, 50, 60 to the retracted or idle position of FIG. 1 allowing the cutter apparatus 10 to be retrieved from the wellbore 36.

When a longer centralization is needed, the apparatus 10 offers the option to add other segments 86, 90 thus lengthening the centralization area and keeping the sequential action. As many segments as are needed can be configured to add centralizers segments 18, 20 or cutter segments 16. The piston would also have to be lengthened (as by adding a second mandrel 25 to the first mandrel 25 by screwing them together, or by replacing mandrel 25 with a similar but longer mandrel 125 having more bevels 28 and 30) to accommodate the added length. A spacer segment 92 could also be used to accomplish a desired length, using one or more centralizer segments 86, 90 (see FIG. 9).

Figure 18:
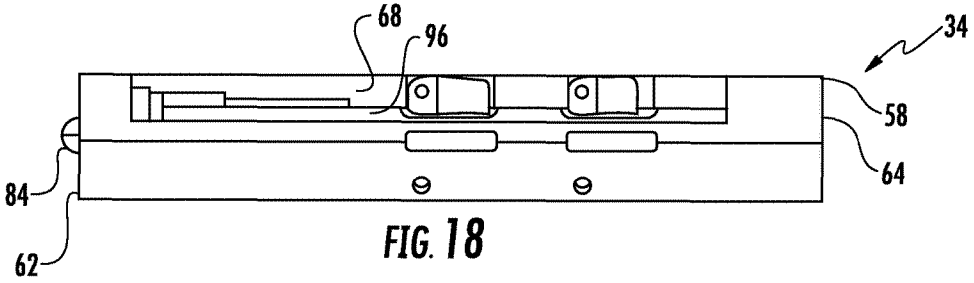
FIG. 18 is a partial perspective view of a preferred embodiment of the apparatus of the present invention showing a descaling tool.
Figure 17:
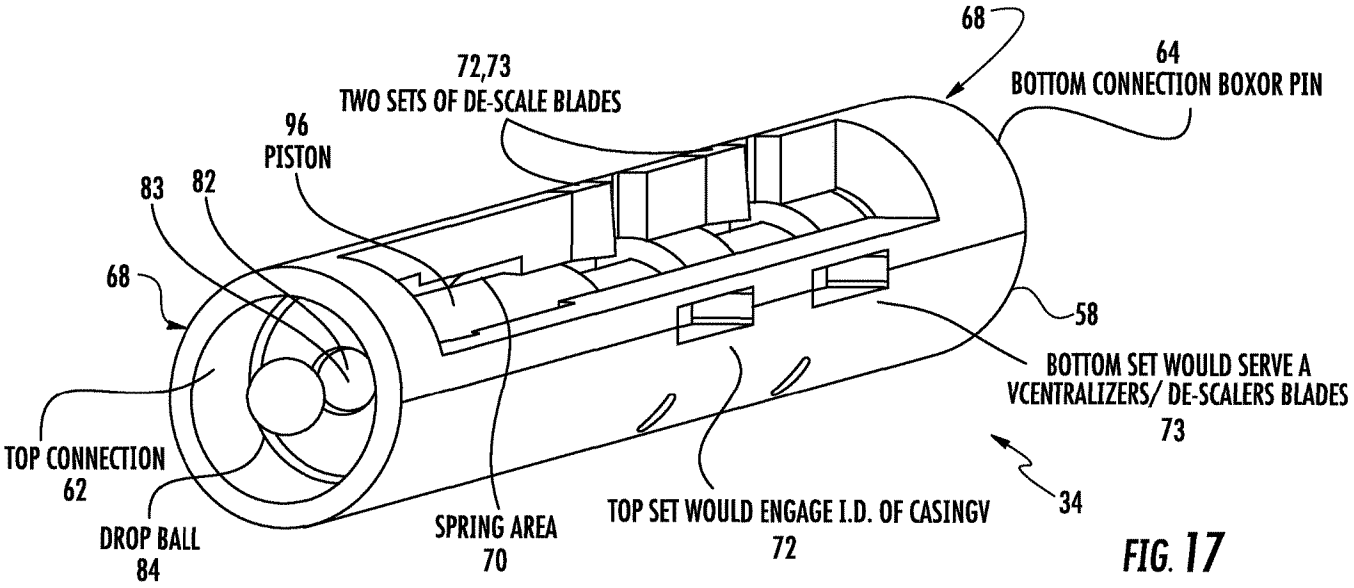
FIG. 17 is a partial perspective view of a preferred embodiment of the apparatus of the present invention showing a descaling tool.
Figure 21:
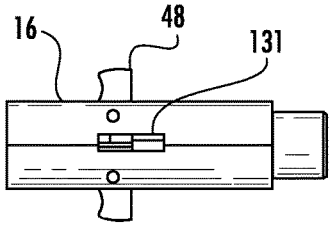
FIG. 21 is a partial side view of a preferred embodiment of the apparatus of the present invention.
Figure 19:
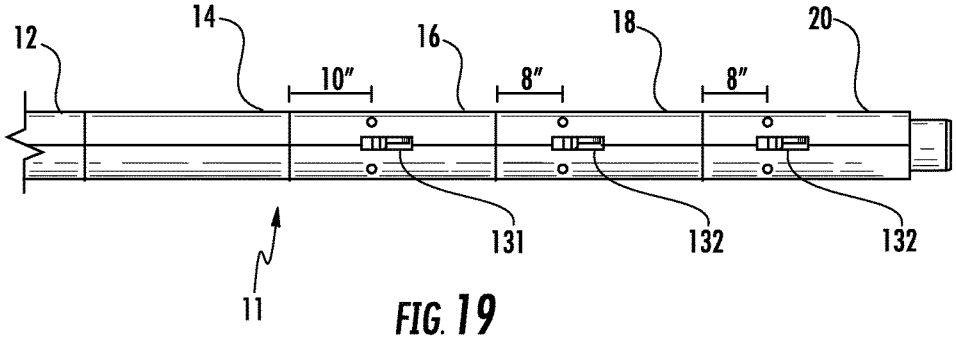
FIG. 19 is a partial side view of a preferred embodiment of the apparatus of the present invention.
Figure 20:
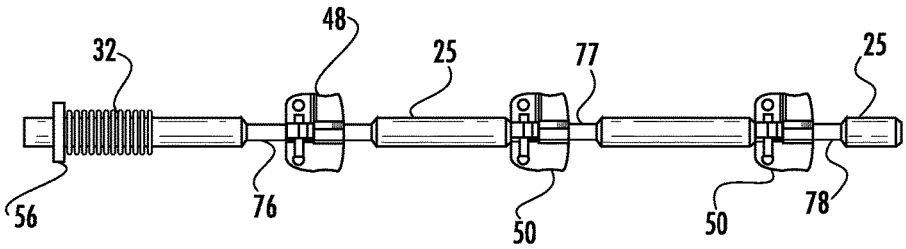
FIG. 20 is a partial side view of a preferred embodiment of the apparatus of the present invention.
Figure 24:
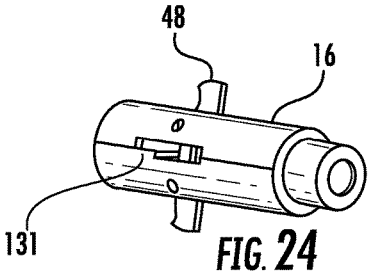
FIG. 24 is a partial perspective view of a preferred embodiment of the apparatus of the present invention.
Figure 22:
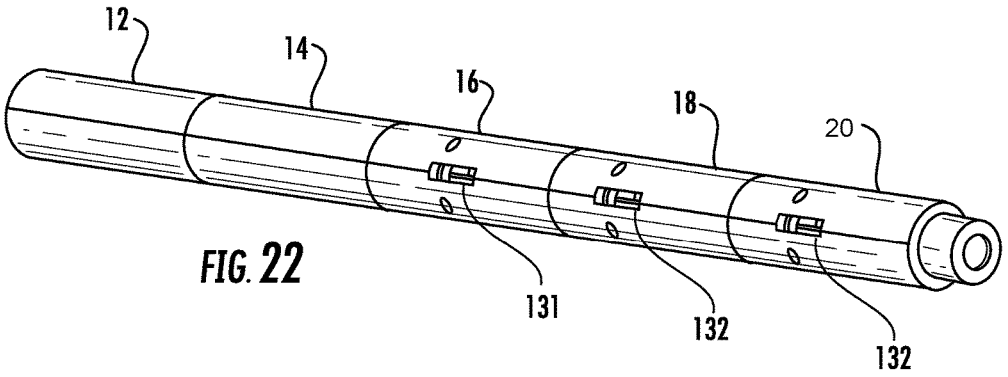
FIG. 22 is a partial perspective view of the preferred embodiment of the apparatus of the present invention.
Figure 23:
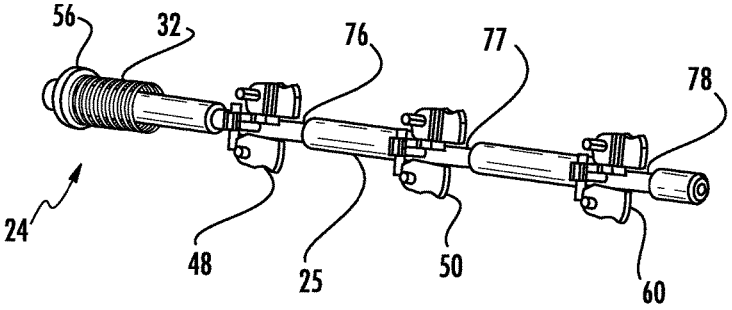
FIG. 23 is a partial perspective view of a preferred embodiment of the apparatus of the present invention.
Figure 25:
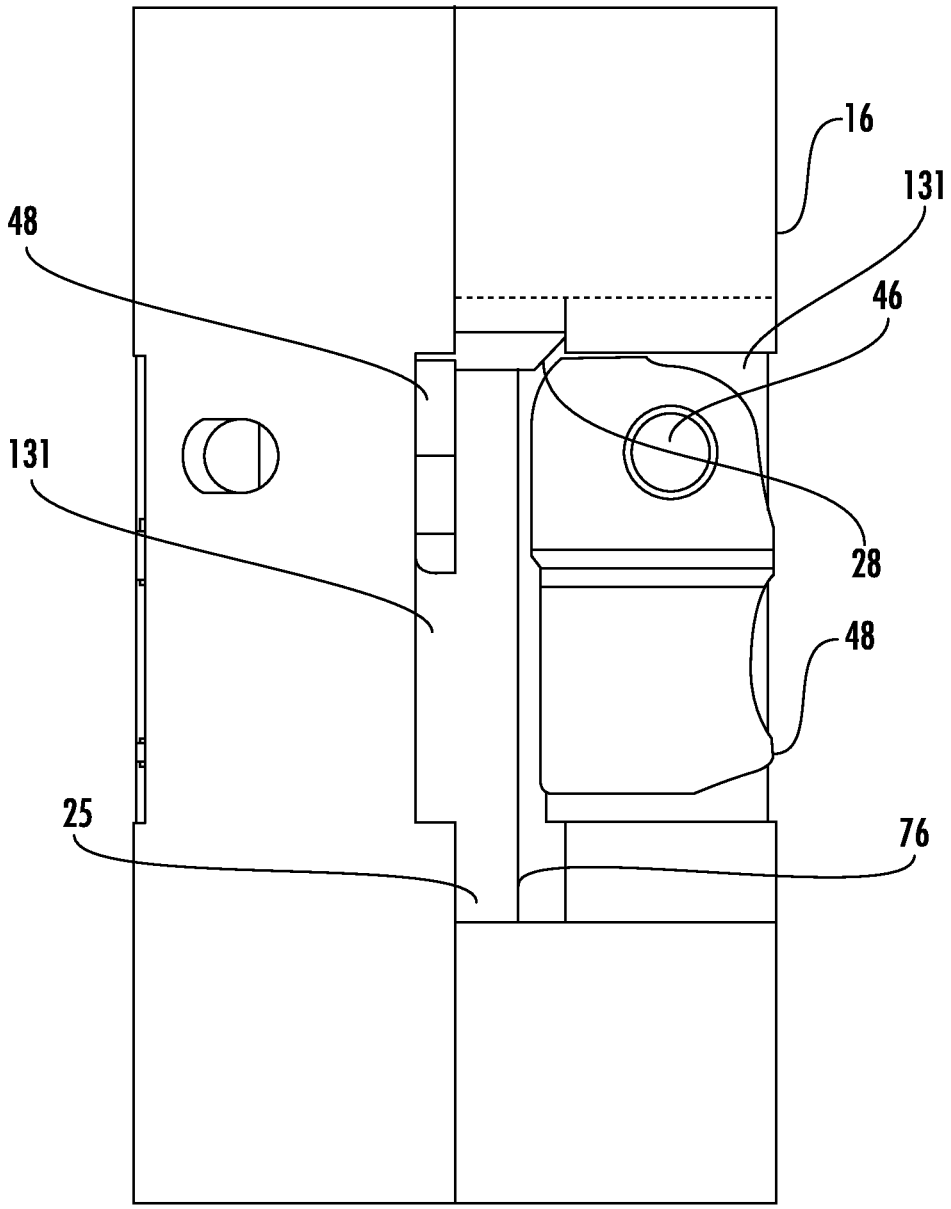
FIGS. 25-29 are fragmentary, sequential views of a preferred embodiment of the apparatus of the present invention showing blade movement from retracted to extended position.
Figure 26:
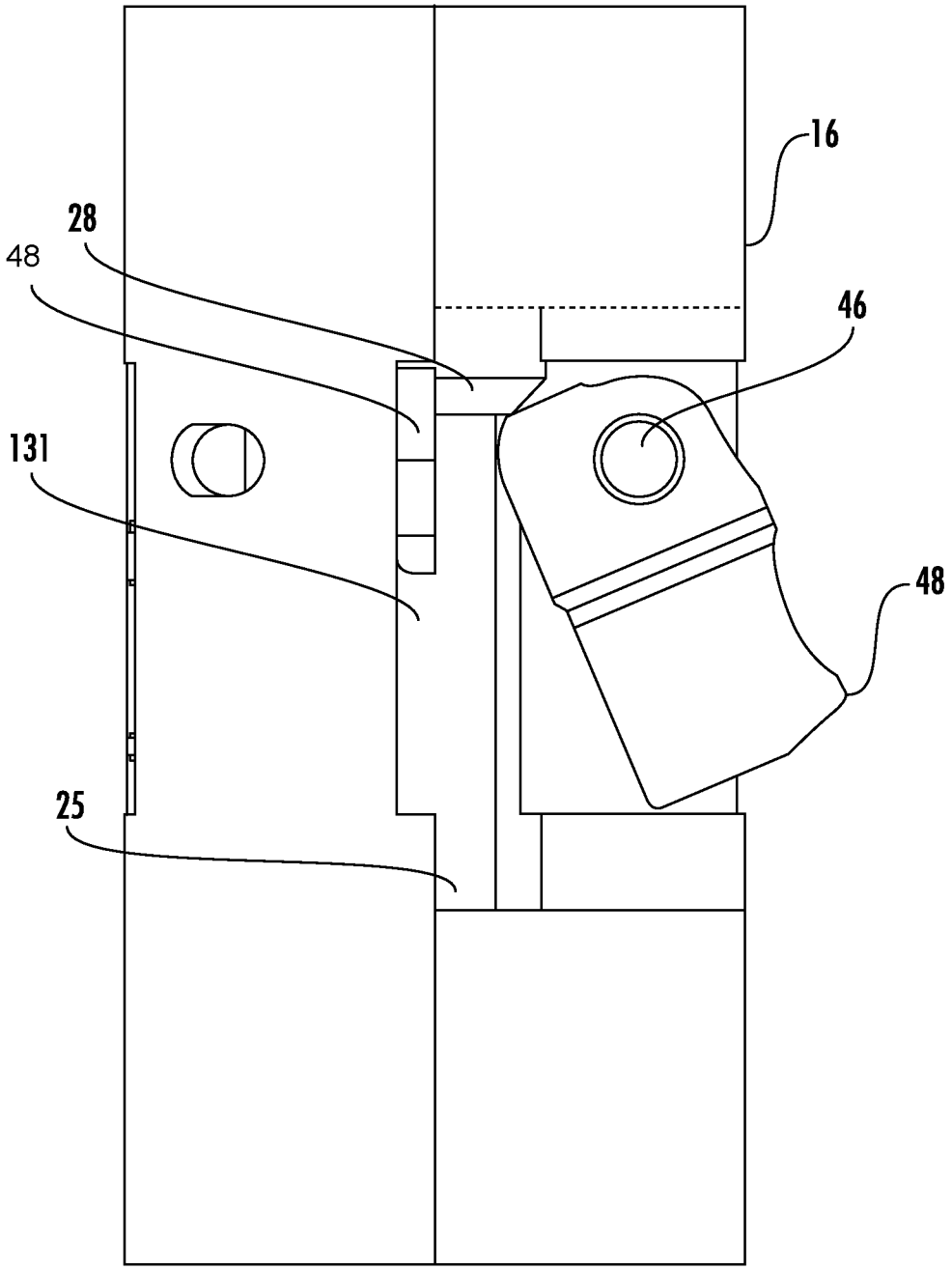
Figure 27:
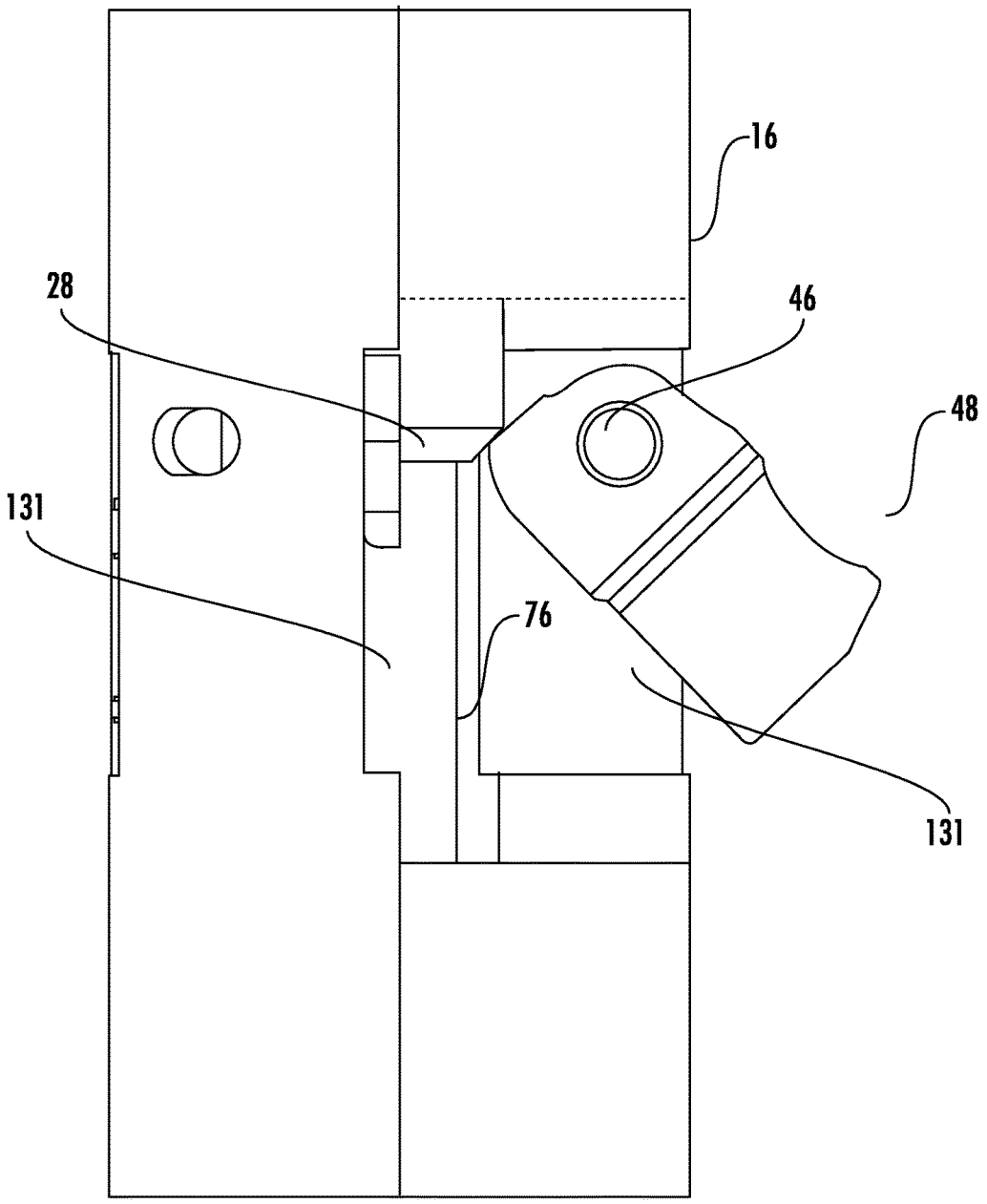
Figure 28:
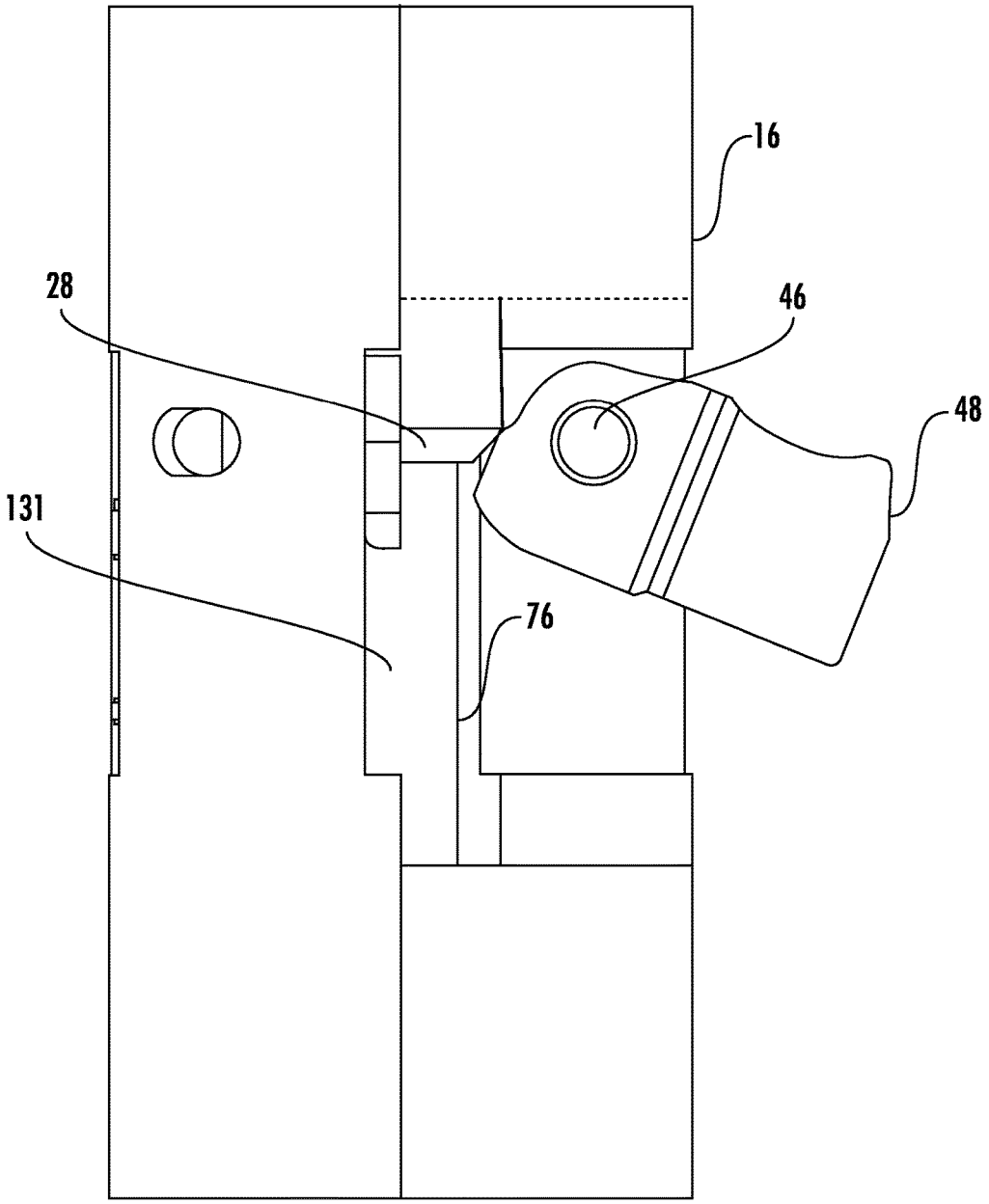
Figure 29:
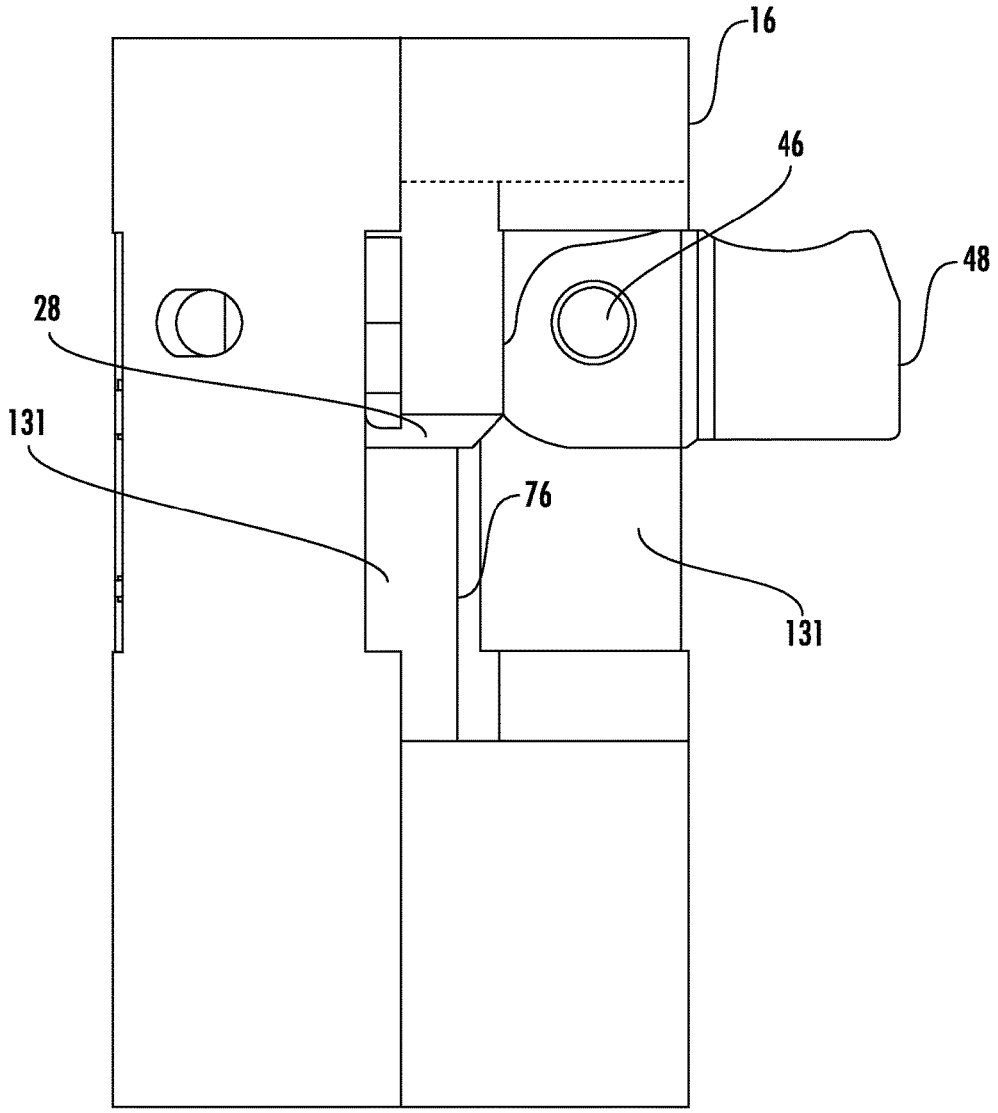
Figure 31:
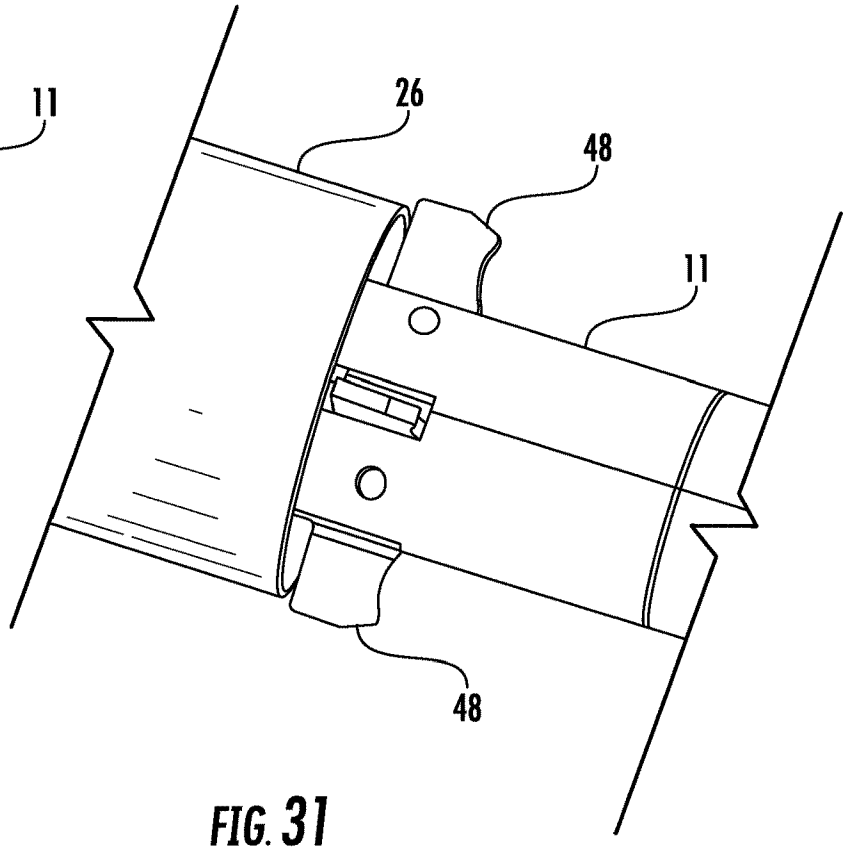
FIG. 31 is a fragmentary view of a preferred embodiment of the apparatus of the present invention.
Figure 30:
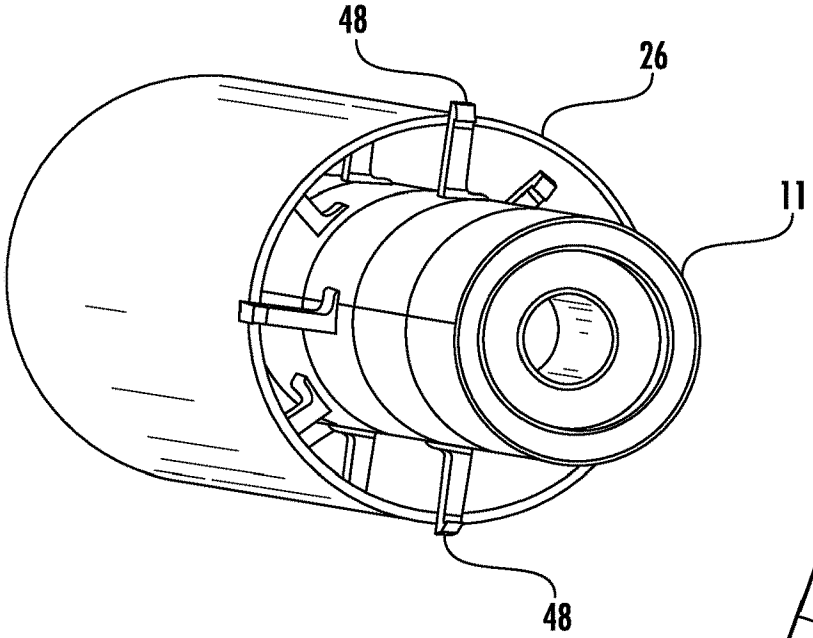
FIG. 30 is a fragmentary view of a preferred embodiment of the apparatus of the present invention.
Figure 32:
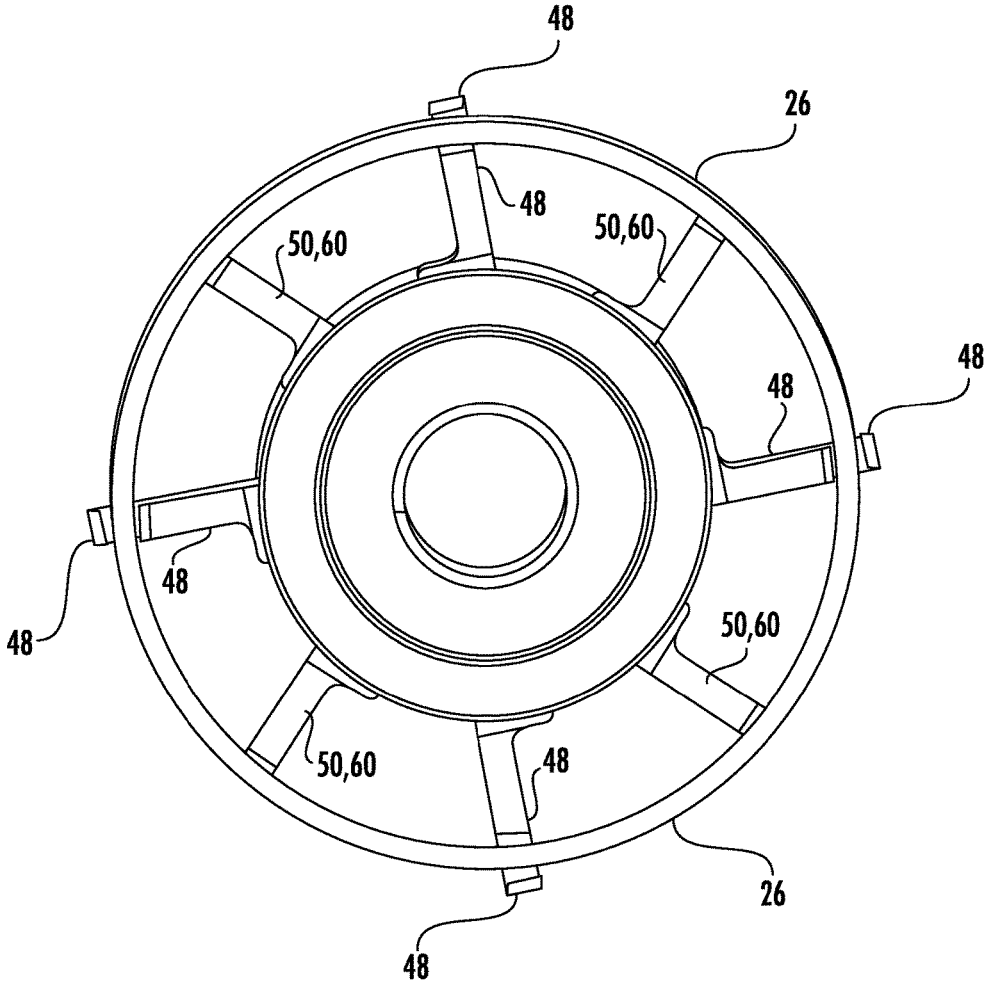
FIG. 32 is a fragmentary view of a preferred embodiment of the apparatus of the present invention.

FIGS. 17 and 18 show a descaling tool 34 that could be used with the apparatus 10. Descaling tool 34 has top connection 62 and bottom connection 64. These connections 62 and 64 could be box or pin type connections for example. Piston 96 is slideably mounted in longitudinal open-ended bore 68 of tool body 58. Piston 96 is spring loaded with a spring (not shown) like spring 32 that occupies spring area 70. Two sets of descale blades are provided: top set 72 and bottom set 73.

Blades 72 and 73 could be actuated by dropping a ball 84 from the well surface area and via drill string or work string 40. Ball 84 closes piston bore 83 by occupying hole 82. Pump pressure on ball 84 pushes piston 96 from a position closer to top connection 62 to a deployed position closer to bottom connection 64. The blade sets 72 and 73 would be moved to an extended position by piston 96 in the same way that the piston mandrel 25 moves the blades 48 and centralizers 50 and 60 to the extended position. Descaling tool 34 could be connected to the top of piston section or piston housing 14 and below top bushing or top sub 12.

Because of the design of the tool of the present invention, if one wanted to assure extremely efficient descaling of cement, one could make a final run of the tools with all segments being descaling tools 34 to achieve maximum coverage of the I.D. of the casing 26.

Since every segment of the tool preferably is the same in O.D, length, I.D, and connections, the machining cost and inventory is as manageable as can be. Preferably one has a basic sub, and then depending on whether one is going to make it into a knife body, a centralizer body, or a descaling body, the cost of prepping is held to a minimum.

Segments of the piston can be added together to achieve the length that would be needed in set up. Also, I.D. is all the way through for flow purposes and also to utilize the pressure for other operations (like the descaling run).

The present design preferably incorporates a solid shaft as the piston 66 (though it preferably has a bore 27 through it). There is preferably a solid design for the cutting blades 48, descaling blades 72, 73, and stabilization blades 50, 60. Stabilization is key and may be the reason others are having issues when section-in-section milling.

The timing is based off of the design of each sub. Stabilization blades have a different placement distance from bottom of sub than milling knives. The piston shaft is preferably built the same no matter what. One simply places the knife subs and stabilization subs wherever one wants them and the stabilization blades 50, 60 come out first due to the shorter distance before the upset (bevel 28) on the shaft 66 reaches them. Then the knives 48 begin to extend as one mills out and/or down. One can place multiple sets of stabilization subs below and/or above, etc.

The descaling sub would act similarly, and would also have a shaft with a flow path through the center to allow for section milling first. Then one would drop the ball 84 and engage the piston 96, actuating the descaling shaft following the same principle as above (centralizing blades then descaling blades with multiple subs). The ball 84 can be removed by retrieving the tool from wellbore 36 and dismantling the top sub from descaling tool 34 and removing the ball 84.

Instead of using a flotel 42, one could for example activate piston assembly 24 by using an increase in pressure with an inner diameter restriction in piston assembly 24 with a flotel 42. The tool could be run without the flotel 42 and would work. Pressure still must be applied to the piston 66, but that could be done with just a differential in the flow area of the fluid coming down the work string 40 and engaging an inner diameter restriction in the piston 66. That would cause the piston 66 to move downward. Flotel 42 is an added part that works as a "tattle tale" or indicator that the piston 66 has moved downward and performed the duty of driving out the knives 48 into the cutting and running position. It is an advantage in that it highlights the drop in pressure differential to let the operators see and know what the tool is doing.

Also, instead of a flotel 42 and a restricted flow area through piston 66, one could for example use a ball or a dart to push piston 66 downward to engage the blades, or could use any other activation mechanism known to those of ordinary skill in the oil field to push piston 66 downward.

In an embodiment of the present invention, the descaling sub 34 would preferably be run directly on top of the piston sub 14 of the section mill assembly of the present invention. In an embodiment of the present invention, the descaling sub 34 has preferably two sets of descaler blades 72, 73 in which the top set of descaler blades is preferably for engaging the I.D. of casing 26, and in which the bottom set of descaler blades would preferably serve as centralizers/descalers blades.

The following is a list of parts and materials suitable for use in the present invention:

PARTS LIST

Part Number Description
10 down hole cutter tool apparatus
11 tool body
11A central longitudinal axis
12 top bushing/top section
14 piston housing/piston section

16 cutter section/tool segment
18 centralizer section/tool segment
20 centralizer section/tool segment
22 bottom sub/bottom section
24 piston assembly
25 mandrel
26 casing/casing section
27 piston bore
28 upper bevel
30 lower bevel
32 spring
34 descaling tool
36 wellbore
38 connection/threaded connection
40 drill string/work string
41 O-ring
42 flotel/fluid flow restriction device
43 seal
44 formation
45 packing member seat or washer
46 pivot pin
47 snap ring
48 cutter blade/knife
49 groove for snap ring
50 stabilizer/centralizer
51 central opening in flotel 42
52 contact radius area
54 shoulder of sub 14 for limiting travel of piston 66
56 shoulder of piston 66 for engaging shoulder 54 of sub 14
58 tool body
59 jet in central opening 51 in flotel 42
60 stabilizer/centralizer
62 top connection
64 bottom connection
66 piston of piston assembly 24
68 bore
70 spring area
72 blade set
73 blade set
74 annulus
76 recess
77 recess
78 recess
80 stem
82 hole
83 piston bore
84 ball
85 upper end portion
86 centralizer segment
90 centralizer segment
92 spacer segment/extension sub
96 piston of descaler tool
125 longer mandrel similar to mandrel 25
130 lower pin of sub 22
131 openings in cutter sub 16 for knife 48
132 openings in centralizer subs 18, 20 for centralizer blades 50, 60
136 seal
172 connection All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A down hole oil and gas well tubular cutting apparatus, comprising:

a) a tool body having upper and lower end portions and a flow conveying bore, said body having at least three connected sections;

b) an elongated mandrel occupying the bore, said mandrel having upper and lower end portions and a central, longitudinally extending fluid channel that enables fluid flow between said upper and lower mandrel ends;

c) the tool body upper end portion enabling connection to a work string or drill string;

d) the mandrel including a piston mounted in the tool body bore, said piston being movable between first and second positions;

e) one or more centralizers movably mounted to the tool body at one of said sections;

f) one or more cutters movably mounted to the tool body at another of said sections;

g) said centralizers being movable from a recessed position to an extended position responsive to movement of said piston from the first position to the second position;

h) said cutters being movable from a recessed position to an extended position responsive to movement of said piston from the first position to the second position;

i) wherein movement of said piston is effected by application of fluid pressure above said piston;

j) said piston having a plurality of larger diameter sections, a plurality of smaller diameter sections and a plurality of annular shoulders, each annular shoulder abutting a larger diameter section and a smaller diameter section;

k) wherein a first said annular shoulder engages and moves each centralizer and a second said annular shoulder engages and moves each said cutter;

wherein the piston urges the centralizers to the extended position before the piston urges the cutters to the extended position; and wherein said sections are interchangeably connectable so that the centralizers are selectively positionable above or below the cutters.

2. The down hole oil and gas well tubular cutting apparatus of claim 1 wherein said piston moves from the second position to the first position when pressure is reduced above said piston.

3. The down hole oil and gas well tubular cutting apparatus of claim 1 wherein one of said sections contains a plurality of said centralizers.

4. The down hole oil and gas well tubular cutting apparatus of claim 1 wherein one of said sections contains a plurality of said cutters.

5. The down hole oil and gas well tubular cutting apparatus of claim 1 wherein one of said sections contains a plurality of said centralizers, one of said sections contains a plurality of said cutters, and one of said sections that contains cutters is above one of said sections that contains centralizers.

6. The down hole oil and gas well tubular cutting apparatus of claim 1 wherein each of said centralizers has a centralizer cam portion and the centralizer cam portion is engaged by the piston when the piston moves from the first position toward the second position.

7. The down hole oil and gas well tubular cutting apparatus of claim 1 wherein each of said cutters has a cutter cam portion and the cutter cam portion is engaged by the piston when the piston moves from the first position toward the second position.

8. The down hole oil and gas well tubular cutting apparatus of claim 1 wherein the piston has multiple recesses, and wherein each centralizer is positioned next to one of the multiple recesses.

9. The down hole oil and gas well tubular cutting apparatus of claim 8 wherein the piston has one or more beveled surface portions next to one of the multiple recesses.

10. The down hole oil and gas well tubular cutting apparatus of claim 1 wherein the piston has multiple recesses, and wherein each cutter is positioned next to one of the multiple recesses.

11. The down hole oil and gas well tubular cutting apparatus of claim 1 wherein the bore is open ended, enabling flow of fluid from the upper end of the tool body to the lower end of the tool body.

12. The down hole oil and gas well tubular cutting apparatus of claim 1 wherein each cutter is disposed in a pocket of the tool body.

13. The down hole oil and gas well tubular cutting apparatus of claim 12 wherein each pocket has a shoulder and in the extended position, the cutter bears against the shoulder as the tool body moves downwardly.

14. A down hole oil and gas well tubular cutting apparatus, comprising:

a) a tool body having upper and lower end portions and a flow conveying bore;

b) the tool body upper end portion enabling connection to a work string or drill string;

c) a mandrel mounted in the tool body bore, said mandrel being movable between first and second positions;

d) one or more centralizers movably mounted to the tool body;

e) one or more cutters movably mounted to the tool body;

f) said centralizers being movable from a recessed position to an extended position responsive to movement of said mandrel from the first position to the second position;

g) said cutters being movable from a recessed position to an extended position responsive to movement of said mandrel from the first position to the second position;

h) wherein:

said tool body comprises multiple sections connected together, one of said sections contains a plurality of said centralizers, one of said sections contains a plurality of said cutters, and the mandrel urges the centralizers to the extended position before the mandrel urges the cutters to the extended position; and i) wherein said sections are interchangeably connectable so that the centralizers are selectively positionable above or below the cutters.

15. The down hole oil and gas well tubular cutting apparatus of claim 14 wherein movement of said mandrel is effected by application of fluid pressure above said mandrel.

16. The down hole oil and gas well tubular cutting apparatus of claim 15, wherein said mandrel moves from the second position to the first position when pressure is reduced above said mandrel.

17. The down hole oil and gas well tubular cutting apparatus of claim 14 wherein one of said sections that contains cutters is above one of said sections that contains centralizers.

18. The down hole oil and gas well tubular cutting apparatus of claim 14 wherein each of said centralizers has a centralizer cam portion and the centralizer cam portion is engaged by the mandrel when the mandrel moves from the first position toward the second position.

19. The down hole oil and gas well tubular cutting apparatus of claim 14 wherein each of said cutters has a cutter cam portion and the cutter cam portion is engaged by the mandrel when the mandrel moves from the first position toward the second position.

20. The down hole oil and gas well tubular cutting apparatus of claim 14 wherein the mandrel has multiple recesses, and wherein each centralizer is positioned next to one of the multiple recesses.

21. The down hole oil and gas well tubular cutting apparatus of claim 20 wherein the mandrel has one or more beveled surface portions next to one of the multiple recesses.

22. The down hole oil and gas well tubular cutting apparatus of claim 14 wherein the mandrel has multiple recesses, and wherein each cutter is positioned next to one of the multiple recesses.

23. The down hole oil and gas well tubular cutting apparatus of claim 14 wherein the bore is open ended, enabling flow of fluid from the upper end of the tool body to the lower end of the tool body.

24. The down hole oil and gas well tubular cutting apparatus of claim 14 wherein each cutter is disposed in a pocket of the tool body.

25. The down hole oil and gas well tubular cutting apparatus of claim 24 wherein each pocket has a shoulder and in the extended position, the cutter bears against the shoulder as the tool body moves downwardly.

26. A down hole oil and gas well tubular cutting apparatus, comprising:

a) a tool body having upper and lower end portions and a flow conveying bore;

b) the tool body upper end portion enabling connection to a work string or drill string;

c) a mandrel movably mounted in the tool body bore, said mandrel having a central open ended flow bore, said mandrel being movable between first and second positions;

d) one or more centralizers movably mounted to the tool body;

e) one or more cutters movably mounted to the tool body;

f) said centralizers being movable from a recessed position to an extended position responsive to movement of said mandrel from the first position to the second position; and g) said cutters being movable from a recessed position to an extended position responsive to movement of said mandrel from the first position to the second position;

h) wherein:

said tool body comprises multiple sections connected together, one of said sections contains a plurality of said centralizers, one of said sections contains a plurality of said cutters, wherein the mandrel urges the centralizers to the extended position before the mandrel urges the cutters to the extended position, and movement of said mandrel is effected by application of fluid pressure above said mandrel;

i) said mandrel having a plurality of larger diameter sections, a plurality of smaller diameter sections and a plurality of annular shoulders;

j) wherein a first said annular shoulder engages and moves each said centralizer and wherein a second annular shoulder engages and moves each said cutter; and k) wherein said sections are interchangeably connectable so that the centralizers are selectively positionable above or below the cutters.

27. The down hole oil and gas well tubular cutting apparatus of claim 26, wherein said mandrel moves from the second position to the first position when pressure is reduced above said mandrel.

28. The down hole oil and gas well tubular cutting apparatus of claim 26 wherein one of said sections that contains cutters is above one of said sections that contains centralizers.

29. The down hole oil and gas well tubular cutting apparatus of claim 26 wherein each of said centralizers has a centralizer cam portion and the centralizer cam portion is engaged by the mandrel when the mandrel moves from the first position toward the second position.

30. The down hole oil and gas well tubular cutting apparatus of claim 26 wherein each of said cutters has a cutter cam portion and the cutter cam portion is engaged by the mandrel when the mandrel moves from the first position toward the second position.

31. The down hole oil and gas well tubular cutting apparatus of claim 26 wherein the mandrel has multiple recesses, and wherein each centralizer is positioned next to one of the multiple recesses.

32. The down hole oil and gas well tubular cutting apparatus of claim 26 wherein the mandrel has multiple recesses, and wherein each cutter is positioned next to one of the multiple recesses.

33. The down hole oil and gas well tubular cutting apparatus of claim 32 wherein the mandrel has one or more beveled surface portions next to one of the multiple recesses.

34. The down hole oil and gas well tubular cutting apparatus of claim 26 wherein the bore is open ended, enabling flow of fluid from the upper end of the tool body to the lower end of the tool body.

35. The down hole oil and gas well tubular cutting apparatus of claim 26 wherein each cutter is disposed in a pocket of the tool body.

36. The down hole oil and gas well tubular cutting apparatus of claim 35 wherein each pocket has a shoulder and in the extended position, the cutter bears against the shoulder as the tool body moves downwardly.

* * * * *